US008320805B2

(12) United States Patent
Yasumaru et al.

(10) Patent No.: US 8,320,805 B2
(45) Date of Patent: Nov. 27, 2012

(54) IMAGE FORMING APPARATUS HAVING TRANSFER MEMBER SUPPORTED BY ROTATABLE SUPPORTING MEMBER

(75) Inventors: Ichiro Yasumaru, Mishima (JP); Masaru Shimura, Numazu (JP); Seiji Inada, Numazu (JP); Yuuichirou Inaba, Susono (JP); Akinori Takayama, Suntoh-gun (JP); Kazuhiro Doda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/720,170

(22) Filed: Mar. 9, 2010

(65) Prior Publication Data

US 2010/0158586 A1 Jun. 24, 2010

Related U.S. Application Data

(62) Division of application No. 11/719,489, filed as application No. PCT/JP2006/322907 on Nov. 10, 2006, now Pat. No. 7,835,678.

(30) Foreign Application Priority Data

Nov. 11, 2005 (JP) ..... 2005-326849

(51) Int. Cl.
*G03G 15/20* (2006.01)
*G03G 15/01* (2006.01)
*G03G 15/08* (2006.01)

(52) U.S. Cl. ..... 399/308; 399/121; 399/302; 399/310

(58) Field of Classification Search ..... 399/121, 399/297–299, 302, 303, 308, 310, 313, 314
See application file for complete search history.

(56) References Cited

U.S. PATENT DOCUMENTS

| | | | |
|---|---|---|---|
| 5,594,538 | A | 1/1997 | Takekoshi et al. |
| 5,621,512 | A | 4/1997 | Uehara et al. |
| 5,678,149 | A | 10/1997 | Takekoshi et al. |
| 5,697,033 | A | 12/1997 | Ichikawa et al. |
| 5,768,676 | A | 6/1998 | Hokari et al. |
| 5,893,017 | A | 4/1999 | Yamamoto |
| 5,893,665 | A | 4/1999 | Ichikawa et al. |
| 5,918,096 | A | 6/1999 | Sano et al. |

(Continued)

FOREIGN PATENT DOCUMENTS

JP 6-3974 A 1/1994

(Continued)

OTHER PUBLICATIONS

Office Action dated Oct. 17, 2008, in Chinese Application No. 200680006342.8.

(Continued)

*Primary Examiner* — Joseph S Wong
(74) *Attorney, Agent, or Firm* — Fitzpatrick, Cella, Harper & Scinto

(57) ABSTRACT

An image forming apparatus includes a movable belt; a transfer member opposed to the image bearing member with the belt therebetween; wherein the transfer member has a contact surface substantially parallel with a surface of the belt and contacted to the belt, and wherein when the belt is moving, the belt rubs the contact surface, and a toner image is transferred from such a part of image bearing member as is opposed to the contact surface; and a supporting member for supporting the transfer member, the supporting member being swingable.

20 Claims, 24 Drawing Sheets

U.S. PATENT DOCUMENTS

| | | | | |
|---|---|---|---|---|
| 5,923,935 | A | 7/1999 | Yamaguchi | |
| 6,029,037 | A | 2/2000 | Ito | |
| 6,201,944 | B1 * | 3/2001 | Onuki et al. | 399/299 |
| 6,496,679 | B2 | 12/2002 | Kitahara | |
| 6,711,367 | B2 | 3/2004 | Saito et al. | |
| 6,832,059 | B2 | 12/2004 | Fujiwara | |
| 6,963,716 | B2 | 11/2005 | Kobayashi et al. | |
| 2002/0006295 | A1 | 1/2002 | Kitahara | |
| 2002/0018673 | A1 | 2/2002 | Mizoguchi et al. | |
| 2002/0094217 | A1 | 7/2002 | Miyamoto et al. | |
| 2003/0235420 | A1 | 12/2003 | Fujiwara | |
| 2005/0069334 | A1 | 3/2005 | Hashimoto et al. | |
| 2006/0067746 | A1 | 3/2006 | Okazaki | |
| 2006/0245782 | A1 | 11/2006 | Hirai et al. | |
| 2007/0059054 | A1 | 3/2007 | Furukawa | |

FOREIGN PATENT DOCUMENTS

| | | | |
|---|---|---|---|
| JP | 6-342243 | A | 12/1994 |
| JP | 8-137290 | A | 5/1996 |
| JP | 9-34275 | A | 2/1997 |
| JP | 9-120218 | A | 5/1997 |
| JP | 9-230709 | A | 9/1997 |
| JP | 10-78709 | A | 3/1998 |
| JP | 10-232574 | A | 9/1998 |
| JP | 11-143249 | A | 5/1999 |
| JP | 11-219048 | A | 8/1999 |
| JP | 11-219049 | A | 8/1999 |
| JP | 11-352789 | A | 12/1999 |
| JP | 2000-112255 | A | 4/2000 |
| JP | 2000-162884 | A | 6/2000 |
| JP | 2000-315023 | A | 11/2000 |
| JP | 2001-125393 | A | 5/2001 |
| JP | 2001-337549 | A | 12/2001 |
| JP | 2003-156942 | A | 5/2003 |
| JP | 2003-202729 | A | 7/2003 |
| JP | 2003-330284 | A | 11/2003 |
| JP | 2004-29058 | A | 1/2004 |

OTHER PUBLICATIONS

Notice Requesting Submission of Opinion dated Aug. 31, 2009, in Korean Application No. 10-2008-7011139.

International Search Report and Written Opinion of the International Searching Authority, dated Jan. 24, 2007, and mailed on Feb. 6, 2007.

Notification of Reasons for Refusal dated Apr. 1, 2008, in Japanese Application No. 2006-305561.

Notification of Reasons for Refusal dated Jul. 8, 2008, in Japanese Application No. 2006-305561.

Notification of Reasons for Refusal dated Jun. 23, 2009, in Japanese Application No. 2008-228179.

Notification of Reasons for Refusal dated Sep. 15, 2009, in Japanese Application No. 2008-228179.

Notice of Last Preliminary Rejection dated Apr. 20, 2010, in Korean Application No. 10-2008-7011139.

Communication pursuant to Article 94(3) EPC dated Jun. 12, 2012, in European Application No. 06 823 454.1-1240.

* cited by examiner

IMAGE FORMING APPARATUS HAVING TRANSFER MEMBER SUPPORTED BY ROTATABLE SUPPORTING MEMBER

This application is a divisional of U.S. patent application No. 11/719,489, filed Mar. 6, 2009.

TECHNICAL FIELD

The present invention relates to an image forming apparatus, which transfers a toner image borne on an image bearing member, onto an intermediary transfer belt, or recording medium borne on a recording medium bearing belt.

BACKGROUND ART

There have been various electrophotographic technologies for an image forming apparatus. According to one of such technologies, a toner image borne on an image bearing member is transferred onto a belt remaining pinched between the image bearing member and a transfer roller. According to another of such technologies, a belt which constitutes a recording medium bearing member is kept pinched between an image bearing member and a transfer roller, and a toner image borne on the image bearing member is transferred onto the recording medium on the belt.

In either case, a small gap is present between a transfer roller and a belt, in the adjacencies of the nip, that is, the adjacencies of the contact area, between the transfer roller and belt. This gap is present on both sides of the nip, in terms of the moving direction of the belt (rotational direction of the transfer roller). As transfer bias is applied, a transfer electric field is generated in the adjacencies of the two small gaps. These transfer electric fields are less defined, being therefore likely to cause some of the toner particles, which make up the toner image, to scatter, in particular, on the upstream side of the nip (transfer area). In other words, it is possible that these undefined electric fields will lower the transfer performance of the image forming apparatus. As another type of transferring member which makes contact with the inward surface of the belt, there is a transfer blade. The portion of the transfer blade, which opposes the belt, with the presence of a small gap, is extremely small. Therefore, the electric field, such as the above-described one, which is generated in this area is too small to be one of the causes of the unsatisfactory image transfer. Thus, an image forming apparatus employing a transfer blade is unlikely to suffer from the problem that its transfer performance is reduced by the above-mentioned undefined electric field. However, there is a concern that an image forming apparatus which employs a transfer blade is smaller in transfer area, and therefore, lower in transfer efficiency.

Based on the above-described background, it has been proposed to employ an image transferring member different from a transfer blade in terms of the manner of contact between an image transferring member and a belt. For example, it has been proposed to employ an image transferring member in the form of a rectangular parallelepiped, which is substantially greater, in terms of the area of contact between a transferring member and a belt, than an image transferring member in the form of a blade, which contacts the belt only by its edge and its adjacencies.

However, an image transferring member (which hereinafter will be referred to simply as transferring member) which contacts the belt by the entirety of one of its surfaces is greater, in terms of the frictional resistance between the transferring member and transfer belt, than a transferring member which contacts the belt by its edge portion. Thus, it is possible that as the belt is moved, the transferring member, which contacts the belt by the entirety of one of its surfaces, intermittently separates from, and recontacts with, the belt, with irregular intervals, destabilizing the transfer electric field. In some cases, the transferring member which makes contact with the belt by the entirely of one of its surfaces becomes disengaged from its holder, and/or the transferring member itself tears.

DISCLOSURE OF THE INVENTION

Thus, the primary object of the present invention is to provide an image forming apparatus which employs an image transferring member, the entirety of one of the surfaces of which makes contact with the inward surface of a belt (in terms of loop belt forms), and which is characterized in that even while an image forming is actually formed, the image transferring member remains satisfactorily in contact with the belt.

According to an aspect of the present invention, there is provided an image forming apparatus comprising a movable belt; a transfer member opposed to said image bearing member with said belt therebetween; wherein said transfer member has a contact surface substantially parallel with a surface of said belt and contacted to said belt, and wherein when said belt is moving, said belt rubs the contact surface, and a toner image is transferred from such a part of image bearing member as is opposed to the contact surface; and a supporting member for supporting said transfer member, said supporting member being swingable.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, image forming apparatuses in accordance with the present invention will be described in detail with reference to the appended drawings.

<Embodiment 1>

Figure 1:
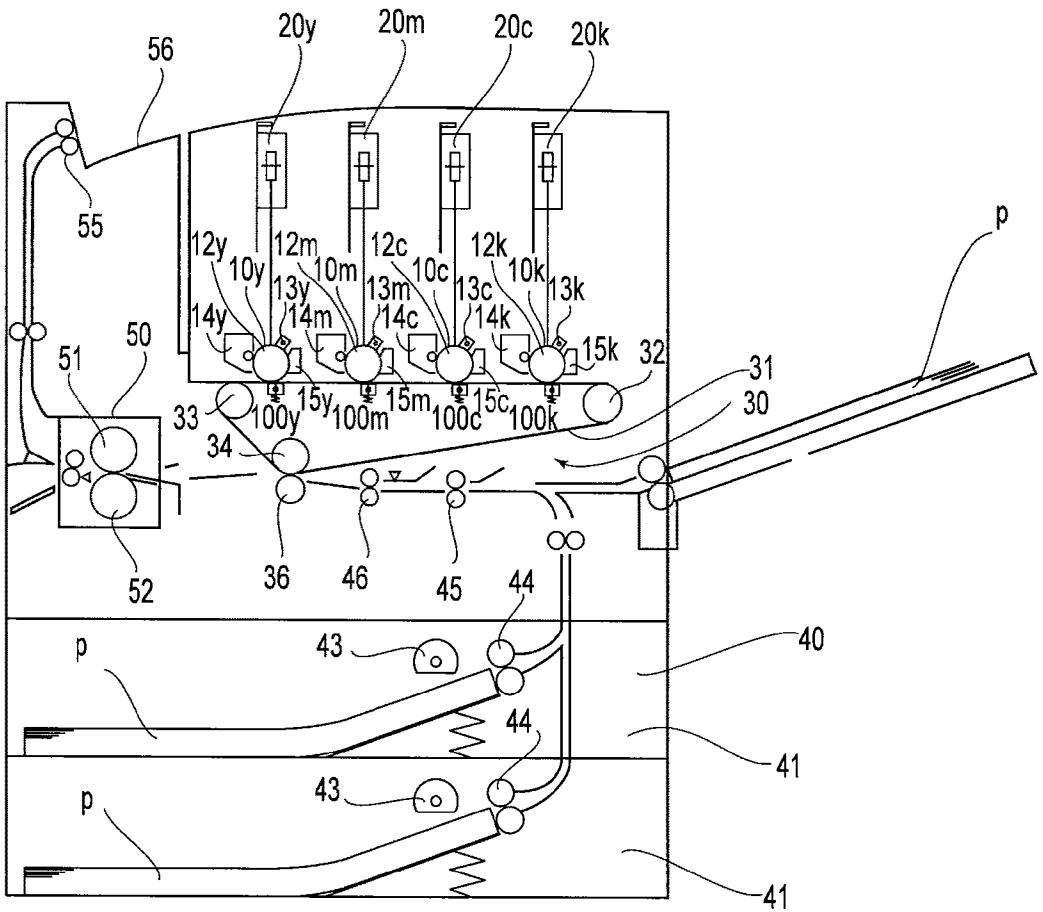
FIG. 1 is a sectional view of the image forming apparatus in the first embodiment of the present invention, showing the general structure thereof.

The image forming apparatus in this embodiment is a color printer having multiple image forming stations. The image forming apparatus shown in FIG. 1 is provided with four image forming stations, which are different in the color of a toner image they form. In the four image forming stations, four process cartridges 10*y*, 10*m*, 10*c*, and 10*k*, which match the four image forming stations, respectively, in terms of the color in which they form an image, are removably mounted. Here, the referential symbols y, m, c, and k stand for yellow, magenta, cyan, and black colors, respectively. The image forming apparatus is also provided with four optical units 20*y*, 20*m*, 20*c*, and 20*k*, which are capable of projecting a beam of laser light while modulating it with picture information, an intermediary transfer unit 30, a recording medium feeding unit 40, and an image fixing unit 50.

The four process cartridge 10*y*, 10*m*, 10*c*, and 10*k* are roughly the same in structure. Each process cartridge 10 (10*y*, 10*m*, 10*c*, and 10*k*) has a photosensitive drum 12, which is an electrophotographic, a charging means 13, a developing means 14, and cleaning apparatus 15.

The intermediary transfer unit 30 has an intermediary transfer belt 31, which is an endless belt, and three rollers 32, 33, and 34 which rotatably supports the intermediary transfer belt 31. The intermediary transfer unit 30 also has a primary transferring means 100 (100*y*, 100*m*, 100*c*, and 100*k*) for transferring a toner image formed on the corresponding photosensitive drum 12, onto the intermediary transfer belt 31.

The intermediary transfer belt 31 moves through the interface between the photosensitive drum 12 (12*y*, 12*m*, 12*c*, and 12*k*) and the primary transferring means 100. In each primary transfer area, a toner image formed on the photosensitive drum 12 is transferred by the corresponding primary transferring means 100, onto the intermediary transfer belt 31. That is, as the intermediary transfer belt 31 is moved through the interfaces between the photosensitive drums 12*y*, 12*m*, 12*c*, and 12*d*, and the intermediary transfer belt 31, the toner images formed on the photosensitive drums 12*y*, 12*m*, 12*c*, and 12*d* are sequentially transferred in layers onto the intermediary transfer belt 31.

Meanwhile, a recording medium P is conveyed by a recording medium supply unit 40 from a feeder cassette 41 to a secondary transfer area. As the recording medium P is delivered to the second transfer area, the toner image having been formed on the intermediary transfer belt 31 is transferred by a secondary transfer roller 36 onto the recording medium P. After the transfer of the toner image onto the recording medium P, the recording medium P is conveyed to the fixation unit 50. In the fixation unit 50, the toner image is fixed in the nip between a fixation roller 51 and a pressure roller 52. Then, the recording medium P is discharged by a pair of discharge rollers 55 onto a delivery tray 56.

Figure 2:
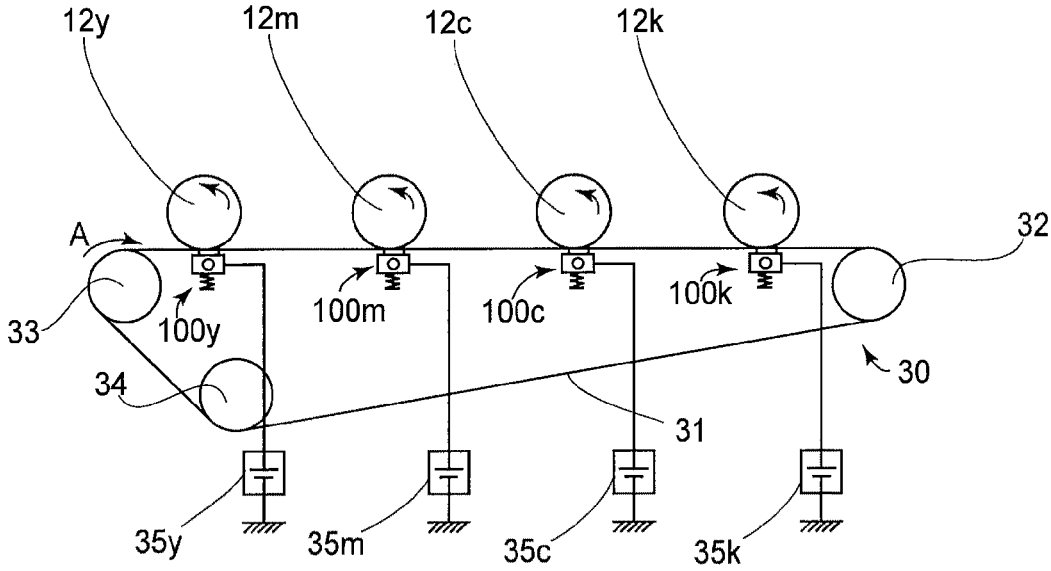
FIG. 2 is a sectional view of the intermediary transfer unit in the first embodiment of the present invention.

Referring to FIG. 2, the intermediary transfer unit 30 comprises the intermediary transfer belt 31, belt tensioning members (rollers 32, 33, and 34), and the primary transferring means 100. The intermediary transfer belt 31 is supported and stretched by the rollers 32, 33, and 34, as described above, and is rotated by the driver roller 32 which rotates as driving force is transmitted thereto from a driving means. As for the photosensitive drums 12*y*, 12*m*, 12*c*, and 12*k* of the process cartridges, they are rotated at roughly the same peripheral velocity as that of the intermediary transfer belt 31.

On the inward side of the loop the intermediary transfer belt 31 forms, the primary transferring means 100*y*, 100*m*, 100*c*, and 100*k*, which are transferring means, are disposed so that they oppose the photosensitive drums 12*y*, 12*m*, 12*c*, and 12*k*, respectively. To the primary transferring means 100 (100*y*, 100*m*, and 100*c*, and 100*k*), an electric power source 35 (35*y*, 35*m*, 35*c*, and 35*k*, respectively) is connected so that a transfer bias capable of causing a preset electric current to flow is applied. As the electric current is supplied to the primary transferring means 100 by the electric power source 35 (35*y*, 35*m*, 35*c*, and 35*d*), the toner image on the photosensitive drum 12, which opposes the primary transferring means 100, is electrostatically attracted onto the intermediary transfer belt 31.

Figure 3:
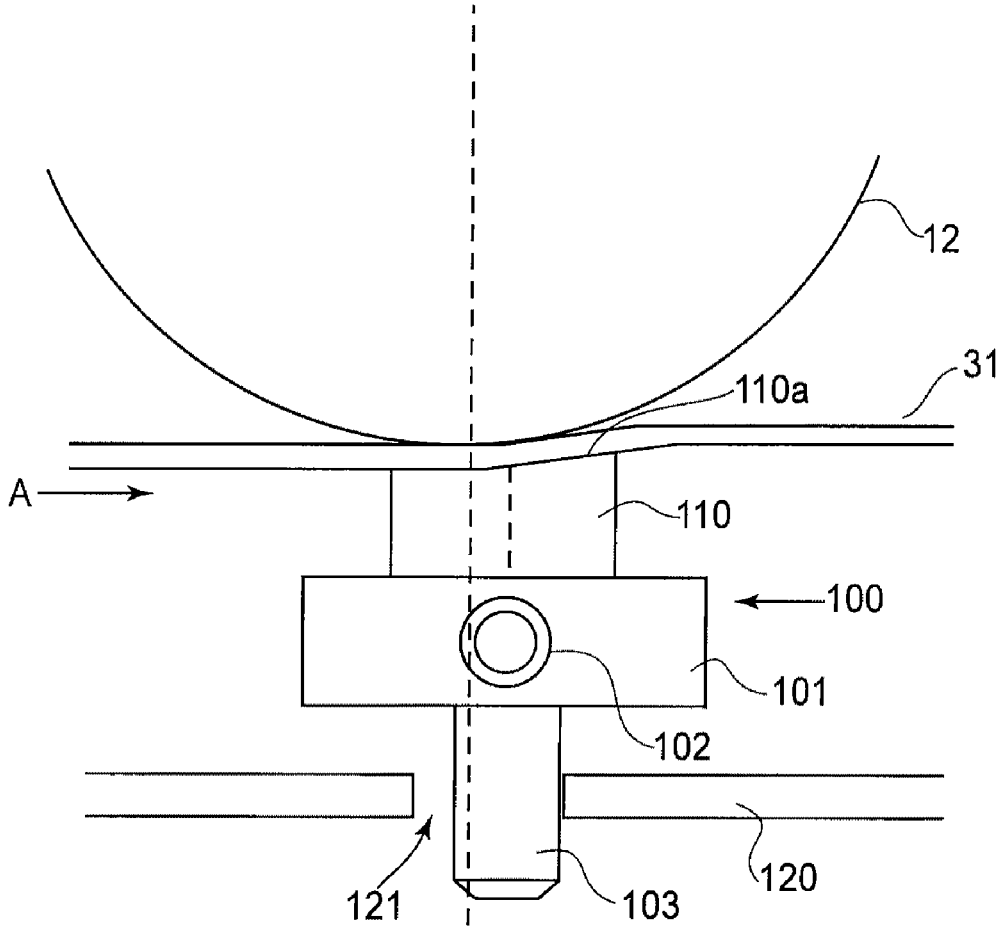
FIG. 3 is a drawing of the image transferring means, and its adjacencies, in the first embodiment of the present invention.
Figure 4:
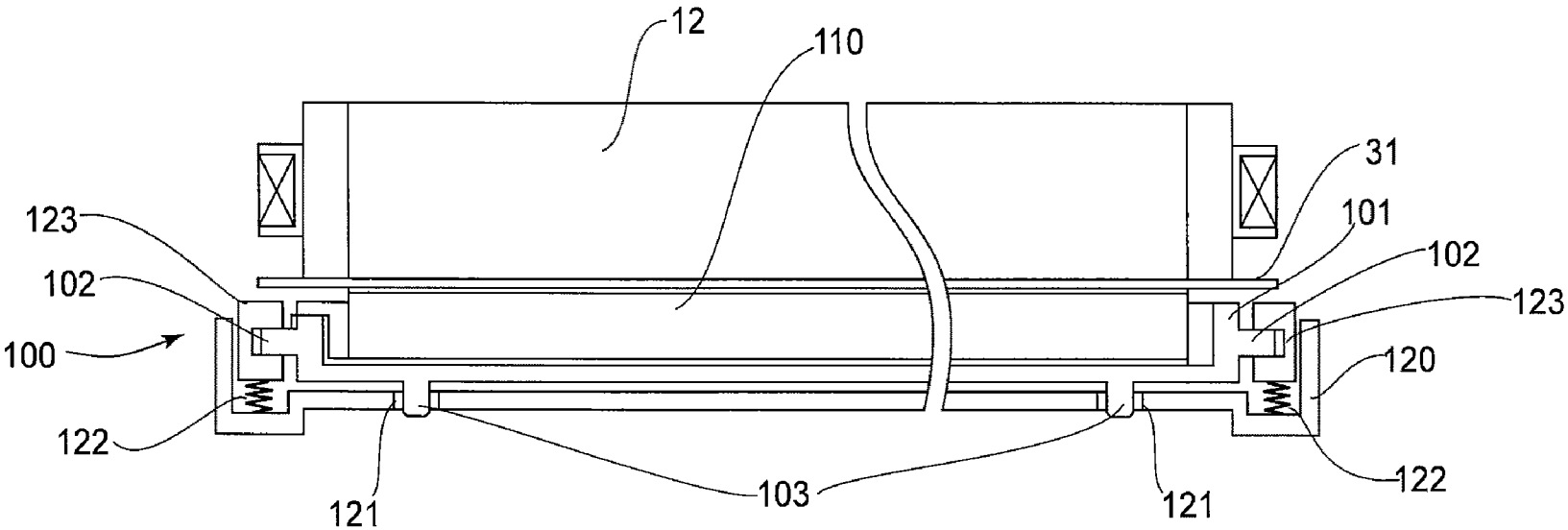
FIG. 4 is a sectional view of the image transferring means, and its adjacencies, in the first embodiment of the present invention.

The detailed structure of the primary transferring means 100 is shown in FIGS. 3 and 4. An elastic member 110, which is roughly in the form of a rectangular parallelepiped, is kept pressed upon the inward surface of the intermediary transfer belt 31, by a pair of compression springs 122. One of the surfaces of the elastic member 110 functions as a contact surface 110*a*, which contacts the intermediary transfer belt 31. The elastic member 110 is positioned so that the contact surface 110*a* is roughly parallel to the inward surface of the intermediary transfer belt 31. Therefore, the entirety of the contact surface 110*a* contacts a preset area of the intermediary transfer belt 31, in terms of the belt movement direction, with no gap between the contact surface 110*a* and intermediary transfer belt 31. The elastic member 110 functions as an image transferring member. It is formed of a foamed substance such as sponge, and is elastically compressible. It is supported by a holder 101 as a supporting member. It is in contact with the intermediary transfer belt 31 by the entirety of its contact surface 110*a*. Therefore, as the intermediary transfer belt 31 moves (rotates), its contact surface 110*a* is rubbed by the intermediary transfer belt 31. As the elastic member 110 is subjected to the frictional force generated by the movement of the intermediary transfer belt 31, the holder 101 tilts. However, the primary transferring means 100 is structured so that the elastic deformation of the elastic member 110 prevents the contact surface 110*a* of the elastic member 110, which directly faces the intermediary transfer belt 31, from separating from the intermediary transfer belt 31. The elastic member 110 is removably held by the holder 101, making it possible for the elastic member 110 to be replaced during the maintenance of the main assembly of the image forming apparatus. The holder 101 has a pair of axles 102, each of which is located directly below the contact surface 110*a* as shown in FIG. 3. Each axle 102 is supported by a bearing 123. Incidentally, the axle 102 does not need to be integral with the holder 101. For example, the holder 101 may be provided with a hole so that an axle, which is independent from the holder 101, can be inserted into the hole. In order to allow the elastic member 110 to move in the direction parallel to the rotational direction of the intermediary transfer belt 31, the holder 101 is supported so that it is allowed to rotationally rock in the direction parallel to the rotational direction of the intermediary transfer belt 31. The holder 101 is provided with a pair of rotation stoppers 103 (rotation regulators) for regulating the amount (rotation range) of the rotational rocking of the holder 101. In other words, the holder 101 is allowed to rotationally rock while being controlled in its rotation range.

Each compression spring 122 presses the corresponding bearing 123, keeping thereby the contact surface 110*a* of the elastic member 110 in contact with the intermediary transfer belt 31, through the bearing 123 and holder 101. The force generated by the resiliency of the compression spring 122 acts in the direction perpendicular to the surface of the intermediary transfer belt 31. The bearing 123 is attached so that its movement is limited by an unshown guiding means to the direction perpendicular to the surface of the intermediary transfer belt 31 (vertical direction in drawing). The holder 101 which supports the elastic member 110 is kept pressured by the pair of compression springs 122 toward the intermediary transfer belt 31 and photosensitive drum 12. Therefore, the intermediary transfer belt 31 is kept pinched by the elastic member 110 and photosensitive drum 12.

The rotation stopper 103 (rocking motion regulating portion) for limiting the rotational rocking range of the holder 101 is fitted in a regulatory hole 121, with which the frame 120 of the intermediary transfer unit 30 is provided. The regulatory hole 121 is greater in diameter than the rotation stopper 103. The rotation stopper 103 is allowed to move within the regulatory hole 121, allowing thereby the holder 101 to rotationally rock in the range which corresponds to the moving range of the rotation stopper 103. The rotation stopper 103 (rocking motion regulating portion) is shaped like a cylindrical pin. The regulatory hole 121 is shaped so that its cross section is in the form of a so-called flat oval.

During an image forming operation, the intermediary transfer belt 31 moves in the direction indicated by an arrow mark A in FIG. 3. The contact surface 110*a* of the elastic member 110 remains thoroughly in contact with the intermediary transfer belt 31. In terms of the moving direction of the intermediary transfer belt 31, the contact area between the elastic member 110 and intermediary transfer belt 31 extends beyond the contact area between the photosensitive drum 12 and intermediary transfer belt 31, both upstream and downstream. The elastic member 110 is shaped like a rectangular parallelepiped for the following reasons: Shaping elastic member 110 like a rectangular parallelepiped makes the contact area between the elastic member 110 and the flat portion of the intermediary transfer belt 31 greater in size than the contact area between a cylindrical transfer roller and the flat portion of the intermediary belt 31, and also, makes the transfer electric field more defined in boundary. Therefore, the elastic member 110 may be in the form of a polygon, as long as one of its surfaces can play the role of the contact surface 110*a*. The elastic member 110 is supported by the holder 101 so that the contact surface 110*a*, which directly faces the inward surface of the intermediary transfer belt 31 remains outside the elastic member holding hole of the holder 101.

Next, the attitude of the elastic member 110 will be described in detail. Referring to FIG. 3, while the intermediary transfer belt 31 is not in the rotational motion, the elastic member 110 remains simply compressed by the compression springs 123 against the intermediary transfer belt 31 in the direction perpendicular to the flat area of the inward surface of the intermediary transfer belt 31, as described above. However, as the intermediary transfer belt 31 rotates, the force which is moving the intermediary transfer belt 31 is transmitted to the elastic member 110 because of the presence of the frictional force between the elastic member 110 and is intermediary transfer belt 31. As this force is transmitted to the elastic member 110, first, the portion of the elastic member 110, which is adjacent to the contact surface 110*a* is deformed downstream in terms of the moving direction of the intermediary transfer belt 31, creating stress in the elastic member 110. Eventually, the entirety of the elastic member 110 is affected by the force applied to the elastic member 110 through the interaction of the rotational movement of the intermediary transfer belt 31 and the above-mentioned frictional force between the contact surface 110*a* and intermediary transfer belt 31; the force pressures the entirety of the elastic member 110 to move downstream in terms of the moving direction of the intermediary transfer belt 31. However, the holder 101 is provided with the pair of axles 102. Therefore, the elastic member 110 rotates with the holder 101 so that the contact surface 110*a* moves in the same direction as the moving direction of the intermediary transfer belt 31. As a result, the pressure distribution in the interface between the contact surface 110*a* and intermediary transfer belt 31 to becomes non-uniform enough to allow the contact surface 110*a* to virtually separate from the intermediary transfer belt 31, reducing thereby the frictional force between the intermediary transfer belt 31 and elastic member 110. As the frictional force reduces, the holder 101 tends to rotationally rock backward about its axles to regain the attitude in which it was before it was rotationally rocked by the movement of the intermediary transfer belt 31; the reduction in the frictional force allows the holder 101 to rotationally rock backward. Therefore, the elastic member 110 neither comes out of the elastic member holding hole of the holder 101, nor tears. This mechanism will be described later in more detail.

While the conditions which affect the attitude of the holder 101 are satisfactory, for example, while the rotational speed of the intermediary transfer belt 31 is extremely stable, the angle (rotational angle) of the holder 101 remains stable during the rotation of the intermediary transfer belt 31. However, while the rotational speed of the intermediary transfer belt 31 is unstable, the rotational angle of the holder 101 fluctuates during the rotation of the intermediary transfer belt 31. In either case, the force to which the elastic member 110 is subjected is absorbed by the rotation of the holder 101 and/or the deformation of the elastic member 110 itself, being thereby prevented from causing the contact surface 110*a* from separating from the intermediary transfer belt 31. Because of the elasticity of the elastic member 110, even when the holder 101 rotates as described above, the elastic member 110 can prevent the contact surface 110*a* from separating from the intermediary transfer belt 31, by deforming.

Further, the rotation stopper 103 is in the regulatory hole 121. Therefore, if the holder 101 is made to excessively tilt, the rotation stopper 103 comes into contact with the edge of the regulatory hole 121, preventing thereby the holder 101 from being further tilted. This setup also contributes to preventing the contact surface 110*a* from separating from the intermediary transfer belt 31.

The direction in which the holder 101 is tilted is preset so that as the holder 101 tilts, the elastic member 110 moves in the same direction as the moving direction of the intermediary transfer belt 31 (direction A in drawing). As is evident from FIG. 4, in terms of the positional relationship between the elastic member 110 and photosensitive drum 12, the image transferring means is structured so that the elastic member 110 does not tilt upstream in terms of the moving direction of the intermediary transfer belt 31. The regulatory hole 121 is not shaped to allow the rotation stopper 103 to move downstream, preventing thereby the elastic member 110 from tilting upstream in terms of the moving direction of the intermediary transfer belt 31.

Figure 5:
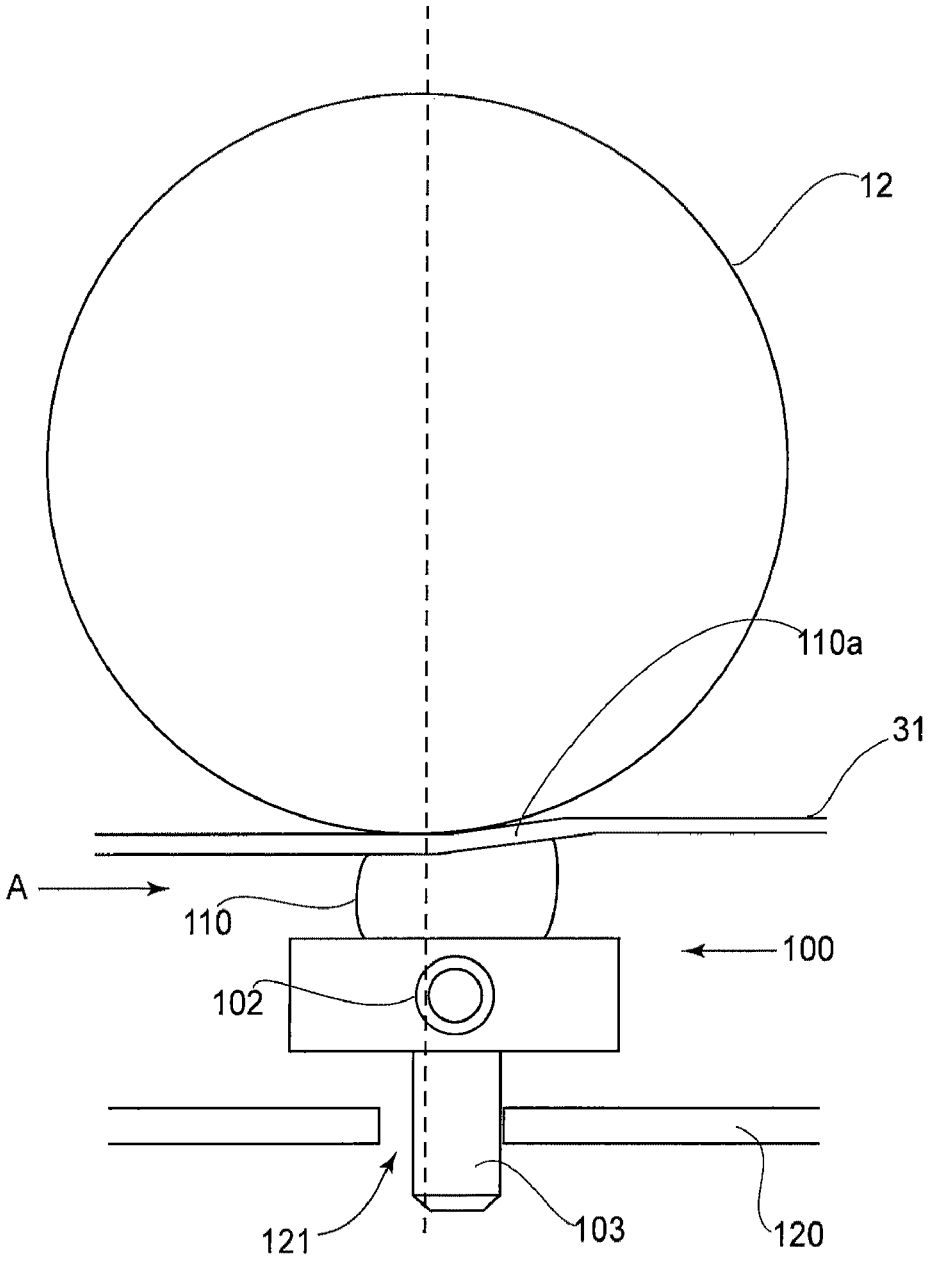
FIG. 5 is a sectional view of the image transferring means, and its adjacencies, in the first embodiment of the present invention.
Figure 6:
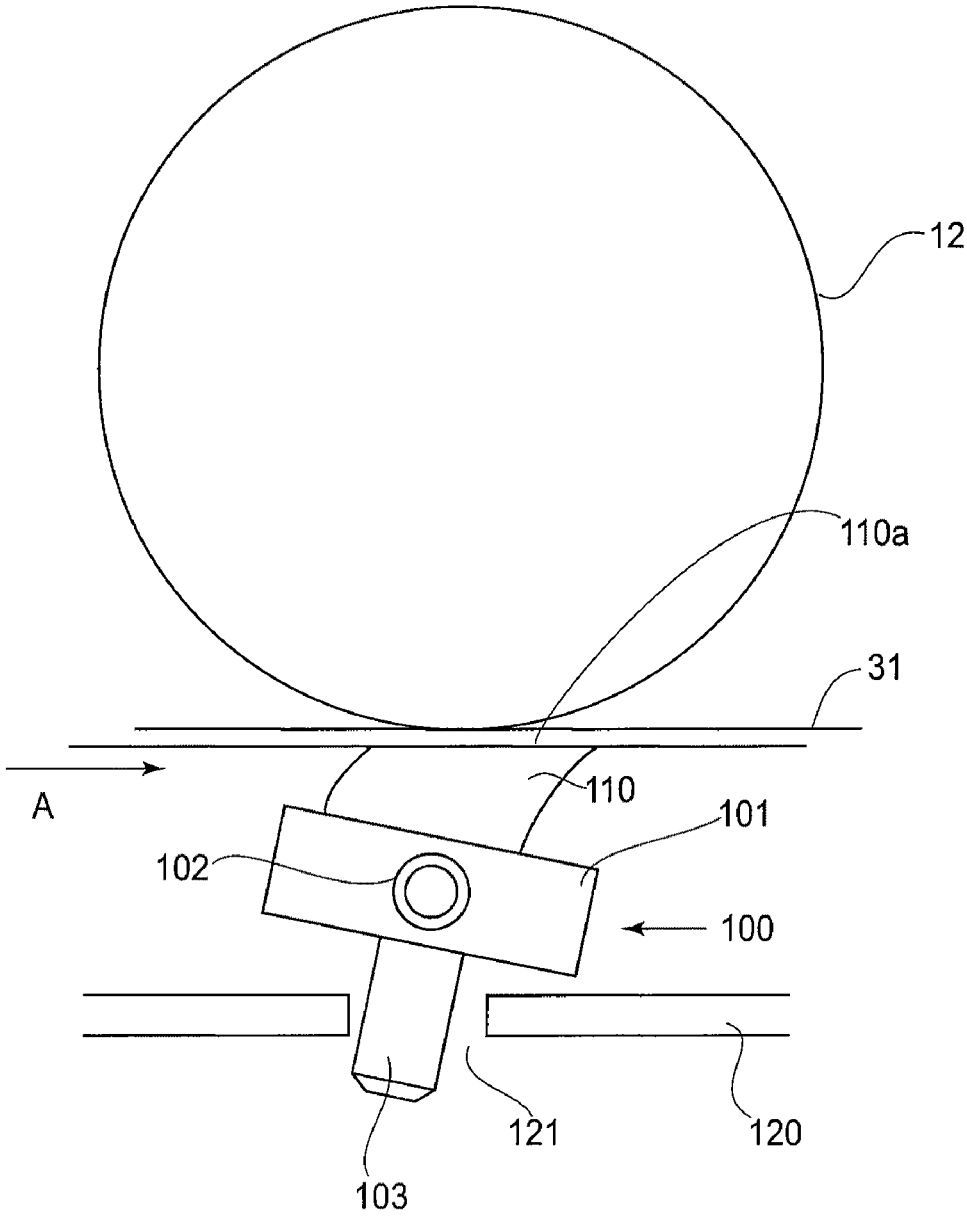
FIG. 6 is also a sectional view of the image transferring means, and its adjacencies, in the first embodiment of the present invention.

Since the transferring means is structured so that the holder 100 is allowed to rotationally rock, the primary transferring means 100 acts as shown in FIGS. 4, 5, and 6. In terms of the moving direction of the intermediary transfer belt 31, the center of the contact area between the contact surface 110*a* and intermediary transfer belt 31 is on the downstream side of the center of the contact area between the photosensitive drum 12 and intermediary transfer belt 31 (FIGS. 4 and 5). This relationship is maintained even while the intermediary transfer belt 31 is moved (FIG. 6). Further, even if the so-called "slick-and-slip" phenomenon occurs between the intermediary transfer belt 31 and elastic member 110, and therefore, such a force that acts in the direction to cause the primary transferring means 100 to tilt in the opposite direction, is generated, the above-mentioned relationship is maintained.

As described above, when the conditions which affect the attitude of the holder 101 are satisfactory, for example, when the rotational speed of the intermediary transfer belt 31 is extremely stable, the rotational angle of the holder 101 remains stable during the rotation of the intermediary transfer belt 31, whereas when the rotational speed of the intermediary transfer belt 31 is unstable, the rotational angel of the holder 101 fluctuates. In either situation, the force to which the elastic member 110 is subjected is absorbed by the rotation of the holder 101 and/or the deformation of the elastic member 110 itself, being thereby prevented from causing the contact surface 110*a* to separate from the intermediary transfer belt 31. Further, the movement of the elastic member 110 in terms of the moving direction of the intermediary transfer belt 31 is limited to the preset range to prevent the primary transfer area from being substantially affected by the movement of the elastic member 110. With the provision of this structural arrangement, it is possible to prevent the problem that the primary transferring means 100 is reduced in transfer efficiency by the deterioration of the transfer area, and the problem that an unsatisfactory image is formed due to the deterioration of the transfer area.

Figure 7:
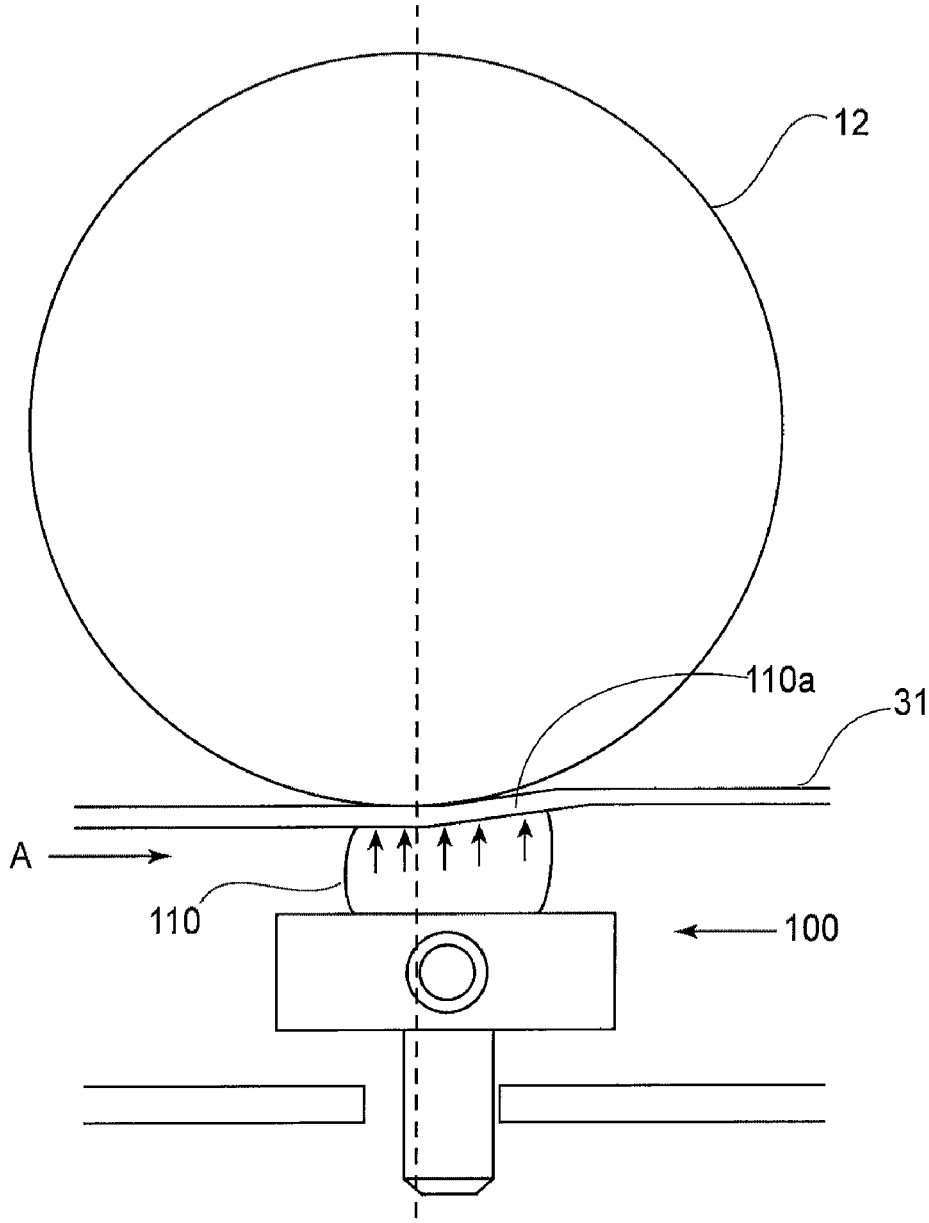
FIG. 7 is a schematic drawing showing the pressure distribution of the image transferring means in the first embodiment of the present invention.
Figure 8:
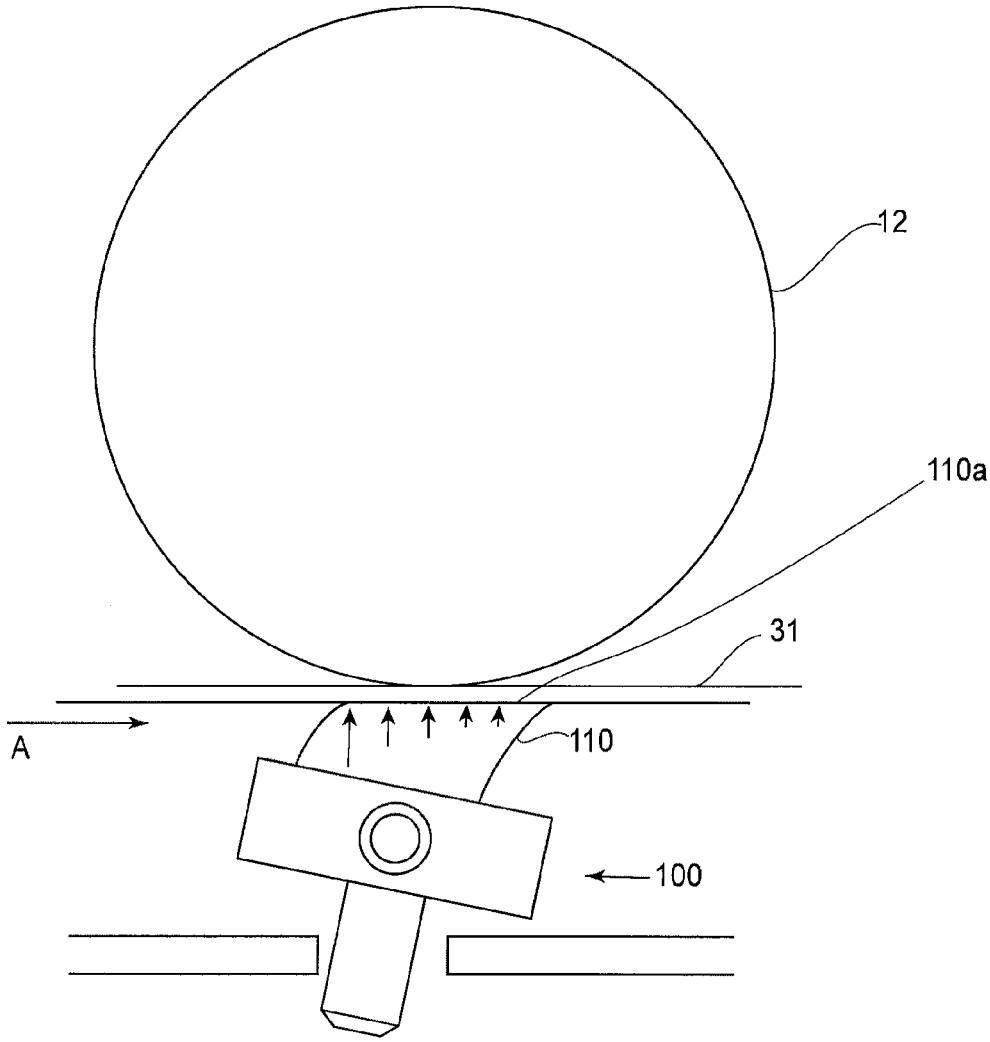
FIG. 8 is also a schematic drawing showing the pressure distribution of the image transferring means in the first embodiment of the present invention.

Next, referring to FIGS. 7 and 8, the rotational rocking motion of the holder 101 and effects thereof will be described. FIG. 7 shows the transfer area, in which the intermediary transfer belt 31 is not in motion. When the transfer area is in the state shown in FIG. 7, the pressure applied to the intermediary transfer belt 31 by the elastic member 110 is roughly uniform in distribution as indicated by multiple arrow marks in the drawing. However, as the intermediary transfer belt 31 moves, the primary transferring means 100 rotationally rocks, changing in attitude as shown in FIG. 8. As a result, the pressure applied to the intermediary transfer belt 31 by the elastic member 110 becomes non-uniform in distribution; the pressure shifts downstream. Therefore, the frictional force between the elastic member 110 and intermediary transfer belt 31 reduces compared to when the transfer area is in the state shown in FIG. 7. That is, it is reasonable to think that the extreme reduction in the amount of the pressure applied by the elastic member 110 to the portion of the intermediary transfer belt 31, which is in the downstream side of the transfer area, contributes to the reduction in the frictional force between the elastic member 110 and intermediary transfer belt 31.

When the frictional force between the elastic member 110 and intermediary transfer belt 31 is small, the attitude of the primary transferring means 100 is as shown in FIG. 7. On the other hand, when the frictional force between the elastic member 110 and intermediary transfer belt 31 is large, the attitude of the primary transferring means 100 is as shown in FIG. 8; the holder 101 is tilted, reducing thereby the frictional force between the elastic member 110 and intermediary transfer belt 31. That is, the attitude of the primary transferring means 100 is affected by the amount of the frictional force between the elastic member 110 and intermediary transfer belt 31; the angle of the primary transferring means 100 settles at a value which corresponds to the point of equilibrium between the frictional force and the rotational moment of the primary transferring means 100.

Incidentally, as long as the primary transferring means 100 settles at an angle corresponding to the above-mentioned point of equilibrium between the frictional force and the rotational moment of the primary transferring means 100 while the intermediary transfer belt 31 is moved, it is feasible to solidly anchor the primary transferring means 100 at the same angle as the above-mentioned equilibratory angle. In reality, however, the moving speed of the intermediary transfer belt 31, and the properties of the inward surface of the intermediary transfer belt 31, do not remain perfectly stable. Therefore, the structural arrangement described above is employed: The holder 101 is allowed to rotationally rock to achieve the state of equilibrium between the frictional force and the rotational moment, in order to keep stable the state of contact between the elastic member 110 and intermediary transfer belt 31 so that the primary transferring means 100 remains stable in transfer performance.

<Embodiment 2>

Figure 9:
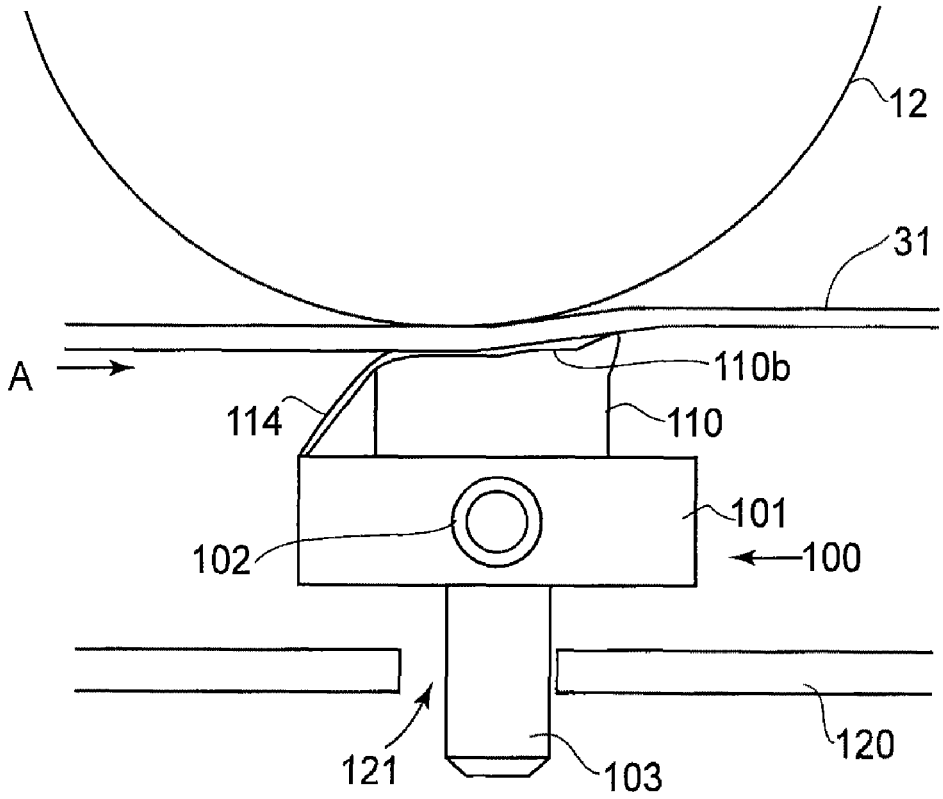
FIG. 9 is a sectional view of the image transferring means, and its adjacencies, in the second embodiment of the present invention.
Figure 10:
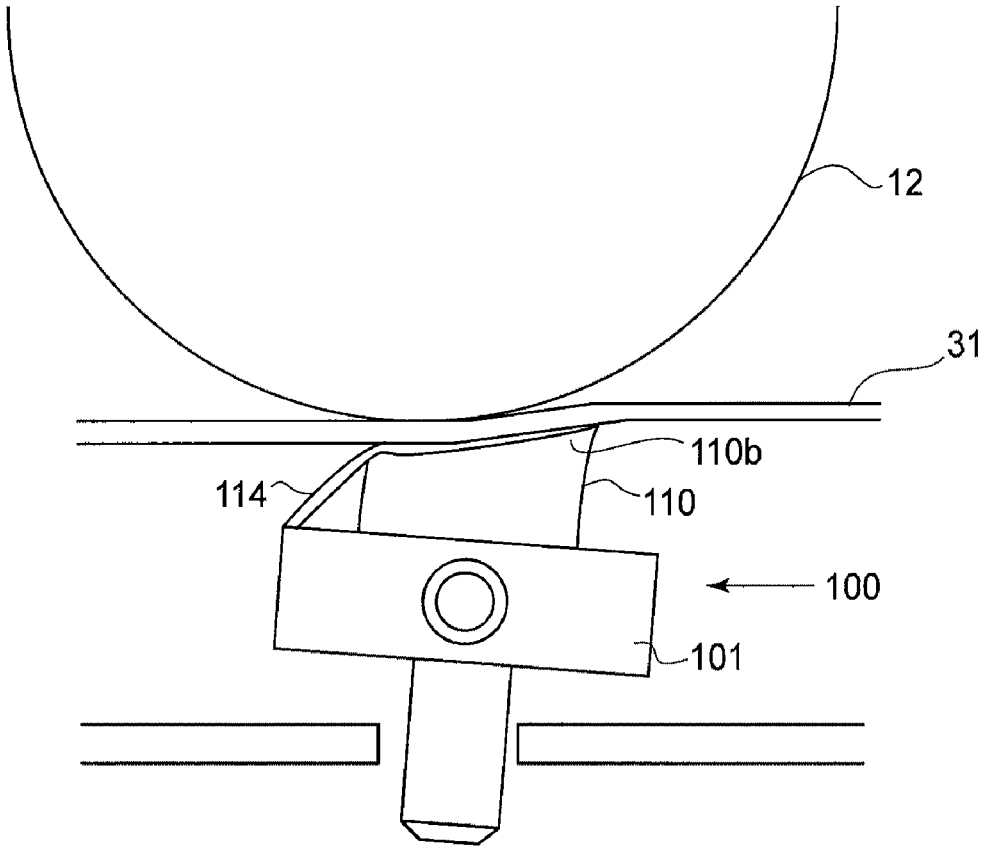
FIG. 10 is also a sectional view of the image transferring means, and its adjacencies, in the second embodiment of the present invention.

Next, referring to FIGS. 9 and 10, the second embodiment of the present invention will be described. The image forming apparatus in this embodiment of the present invention is identical to that in the first embodiment, except for the following features, which will be described next.

That is, in this embodiment, a film 114 is positioned between the elastic member 110 and intermediary transfer belt 31 to make it easier for the intermediary transfer belt 31 to slide relative to the elastic member 110. The coefficient of friction between this film 114 and intermediary transfer belt 31 is rendered smaller than that between the surface 110*b* of the elastic member 110, which faces the film 114, and the intermediary transfer belt 31. The film 114 is a sheet of electrically-conductive film. As transfer bias is applied to the elastic member 110 from the electric power source 35, the transfer electric current flows to the intermediary transfer belt 31 through the film 114. The combination of the film 114 and elastic member 110 functions as an image transferring member. The film 114 is bonded to the holder 101. It is retained between the elastic member 110 and intermediary transfer belt 31 by keeping it pinched between the elastic member 110 and intermediary transfer belt 31.

As stated in the description of the first embodiment, as the intermediary transfer belt 31 rotates, the holder 101 rotates about the axle 102. Up to this point, what occurs to the primary transferring means 100 in this embodiment is the same as that in the first embodiment. In this embodiment, however, the film 114 is present between the elastic member 110 and intermediary transfer belt 31, and the frictional force between the film 114 and intermediary transfer belt 31 is lower than that between the surface 110*b* of the elastic member 110 and intermediary transfer belt 31, as described above. Therefore, the structural arrangement in this embodiment is smaller in the range of the angle, in which the holder 101 rotationally rocks during the rotation of the intermediary transfer belt 31, than the structural arrangement in the first embodiment. Therefore, the structural arrangement in this embodiment is smaller than that in the first embodiment, in terms of the amount of change in the positional relationship between the photosensitive drum 12 and elastic member 110, which occurs when the rotational speed of the intermediary transfer belt 31 is unstable. Therefore, the structural arrangement in this embodiment is more stable than that in the first embodiment, in terms of the position of the transfer electric field formed by the elastic member 110. In this respect, the structural arrangement in this embodiment is superior to that in the first embodiment.

<Embodiment 3>

The image forming apparatus in this embodiment of the present is identical to that in the second embodiment, except for the following features which will be described next.

Figure 11:
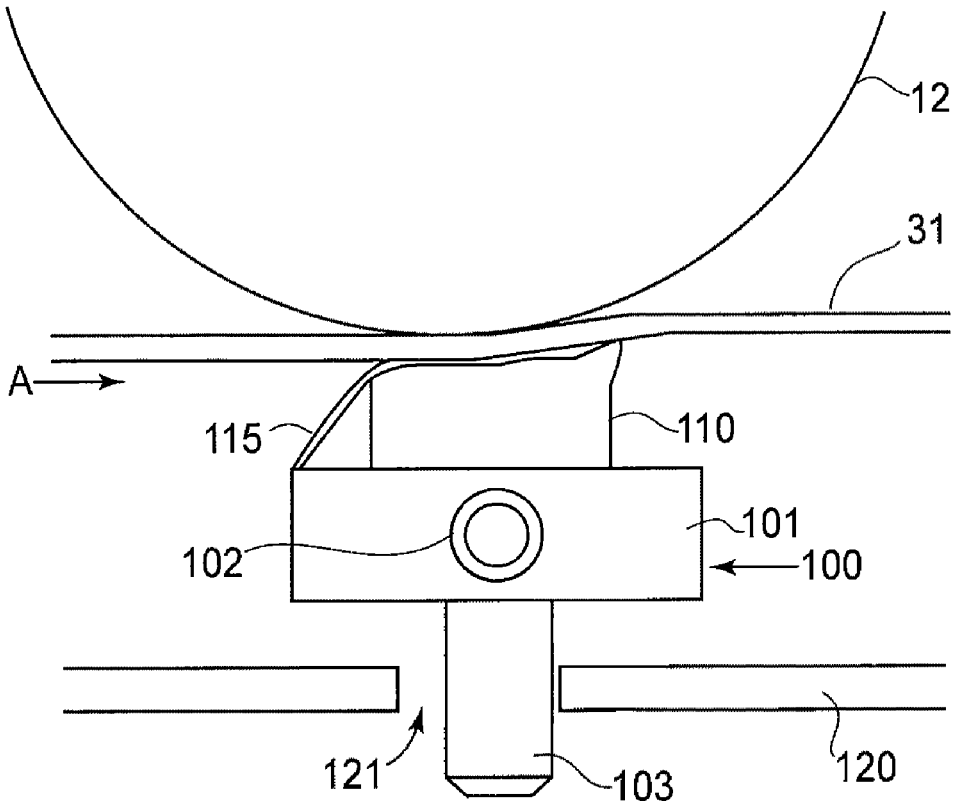
FIG. 11 is a sectional view of the image transferring means, and its adjacencies, in the third embodiment of the present invention.

Referring to FIG. 11, in this embodiment, a film 115 is positioned between the elastic member 110 and intermediary transfer belt 31, as in the second embodiment, to make it easier for the intermediary transfer belt 31 to slide relative to the elastic member 110. However, the film 115 is shorter than the film 114. Further, the film 115 is present only in a part of the contact area between the elastic member 110 and intermediary transfer belt 31. More specifically, the upstream half of the elastic member 110 is kept pressed against the intermediary transfer belt 31, with the presence of the film 115 between it and intermediary transfer belt 31, whereas the downstream half of the elastic member 110 is directly in contact with the inward surface of the intermediary transfer belt 31. The material for the film 115 is the same as that for the film 114. Thus, the coefficient of friction between this film 115 and intermediary transfer belt 31 is smaller than that between the surface of the elastic member 110, which faces the film 115, and the intermediary transfer belt 31. Further, it is electrically conductive. The method used for attaching the film 115 to the holder 101 is the same as that used for attaching the film 114 to the holder 101; the film 115 is also bonded to the holder 101. The combination of the film 115 and elastic member 110 functions as an image transferring means.

Figure 12:
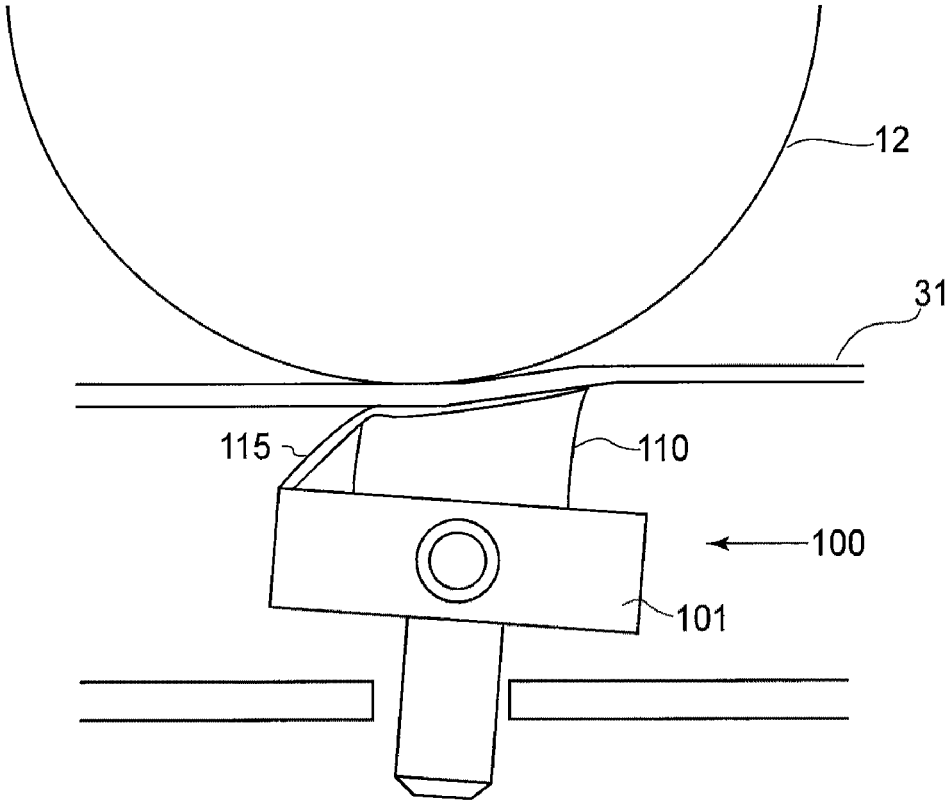
FIG. 12 is another sectional view of the image transferring means, and its adjacencies, in the third embodiment of the present invention.

Referring to FIG. 12, as the intermediary transfer belt 31 rotates, the primary transferring means 100 rotationally rocks about the axle 102. As a result, the elastic member 110 tilts, as stated in the description of the first embodiment. Consequently, the pressure applied to the intermediary transfer belt 31 by the elastic member 110 shifts upstream, in terms of the moving direction of the intermediary transfer belt 31. Thus, the distribution of the pressure applied by the elastic member 110 to the intermediary transfer belt 31 becomes as shown in FIG. 8. In this embodiment, the film 115 is present only between the upstream half of the elastic member 110, and the intermediary transfer belt 31, that is, the film 115 is in the area into which the pressure applied by the elastic member 110 shifts as the intermediary transfer belt 31 rotates, reducing thereby the coefficient of friction in the portion of the transfer area, into which the pressure applied by the elastic member 110 shifts. Therefore, the structural arrangement in this embodiment is smaller than that in the first embodiment, in terms of the frictional force between the elastic member 110 and intermediary transfer belt 31.

In this embodiment, the tilting of the primary transferring means is reduced by roughly the same amount as that in the second embodiment, by the synergistic effect of the reduction in the frictional force between the elastic member 110 and intermediary transfer belt 31, which is effected by the pressure shift as in the first embodiment, and the reduction in the coefficient of friction in the portion of the contact area, into which the pressure shifts. Unlike the second embodiment, this embodiment ensures that the film 115 is pinched by the elastic member 110 and intermediary transfer belt 31, even at its downstream end in terms of the moving direction of the intermediary belt 31. Therefore, this embodiment is superior to the second embodiment in that the film 115 in this embodiment is more stable in behavior than the film 114 in the second embodiment. In the case of the structural arrangement in the second embodiment, the entirety of the surface 110*b* of the elastic member 110 is covered by the film 114. In order to ensure that the surface 110*b* is entirely covered by the film 114, the film 114 needs to be made considerably larger than the surface 110*b*. However, if the film 114 is considerably larger than the surface 110*b*, the portion of the film 114, which extends beyond the surface 110*b*, is not pinched by the elastic member 110 and intermediary transfer belt 31, and therefore, this portion of the film 114 is likely to be unstable in behavior.

Figure 13:
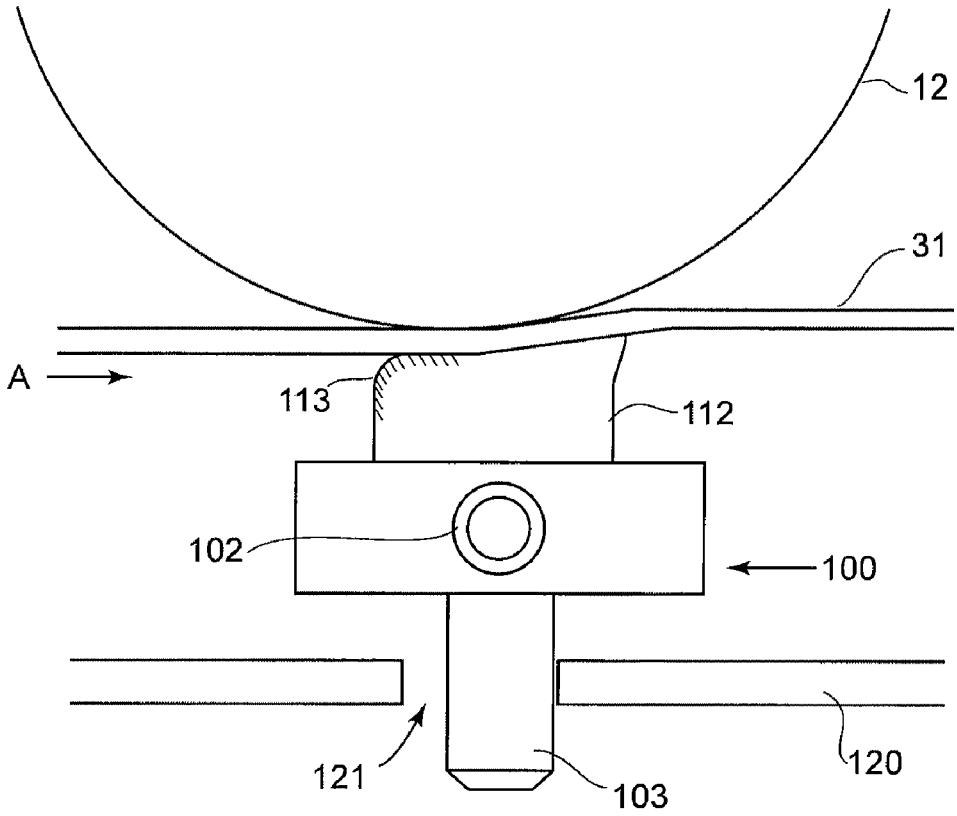
FIG. 13 is yet another sectional view of the image transferring means, and its adjacencies, in the third embodiment of the present invention.
Figure 14:
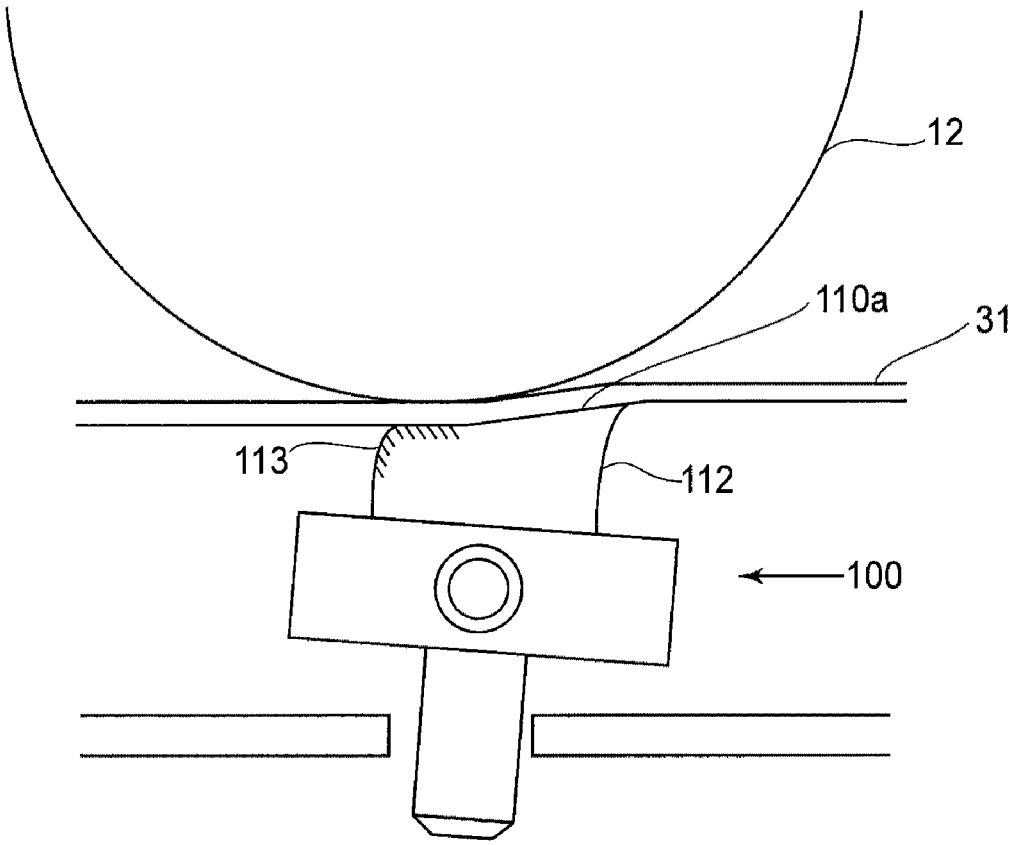
FIG. 14 is another sectional view of the image transferring means, and its adjacencies, in the third embodiment of the present invention.

Incidentally, shown in FIGS. 13 and 14 is one of the modified versions of the structural arrangement in this embodiment, which is similar in effect to this embodiment. In this modification, an area 113, which is a part of the surface of the elastic member 112, is different in properties from the rest of the surface of the elastic member 112. The area 113 is formed by processing the portion of the surface of the elastic member 112, which corresponds to the area 113, in order to reduce this area in the coefficient of friction between this area and intermediary transfer belt 31. This modified version of the third embodiment also has an effect similar to the above-described effect of the third embodiment.

<Embodiment 4>

Figure 15:
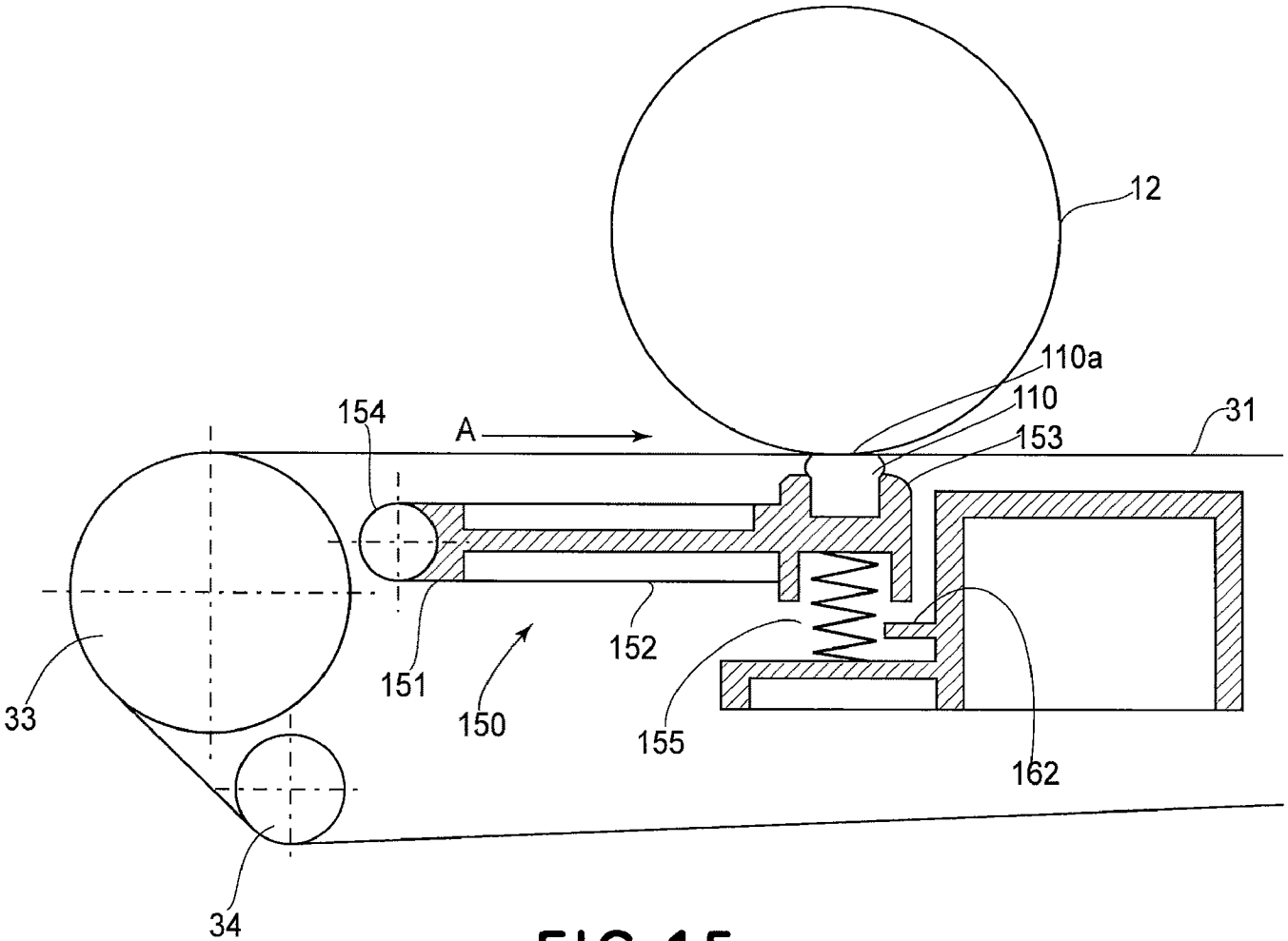
FIG. 15 is a sectional view of the image transferring means, and its adjacencies, in the fourth embodiment of the present invention.
Figure 16:
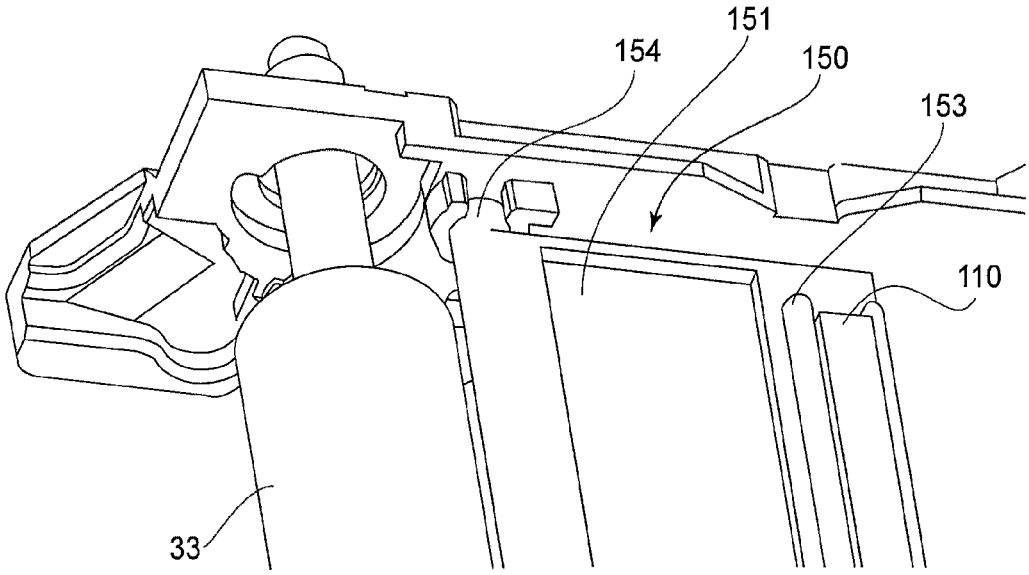
FIG. 16 is a perspective view of one of the lateral end portions of the transferring means in the fourth embodiment of the present invention, showing the structure thereof, except for the intermediary transfer belt.

The image forming apparatus in this embodiment is basically the same in structure as that in the first embodiment, except for the transferring means and its adjacencies. Referring to FIG. 15, in this embodiment, a holder 153 is provided with an arm 152. The arm 152 has a portion which functions as the axle 154 of the holder 153. Thus, the essential difference of the image forming apparatus in this embodiment from that in the first embodiment is that the distance between the axle 154 and the contact surface 110*a* is substantially greater than the distance between the axle 102 and contact surface 110*a* in the first embodiment. The axle 154 of the holder 153 is located upstream of the contact surface 110*a* in terms of the moving direction of the intermediary transfer belt 31. A pair of compression springs 155, which are pressing members, press the elastic member 110, which is located directly above the compression springs 155, upon the intermediary transfer belt 31. Next, the adjacencies of the elastic member 110 in this embodiment will be described in detail with respect to their structures and functions. FIG. 16 is a view of the transferring means and its adjacencies observed from the direction different from that from which they are observed in FIG. 15, showing the general structures thereof. In order to show the structures of the holder, etc., FIG. 16 does not show the intermediary transfer belt 31.

Figure 17:
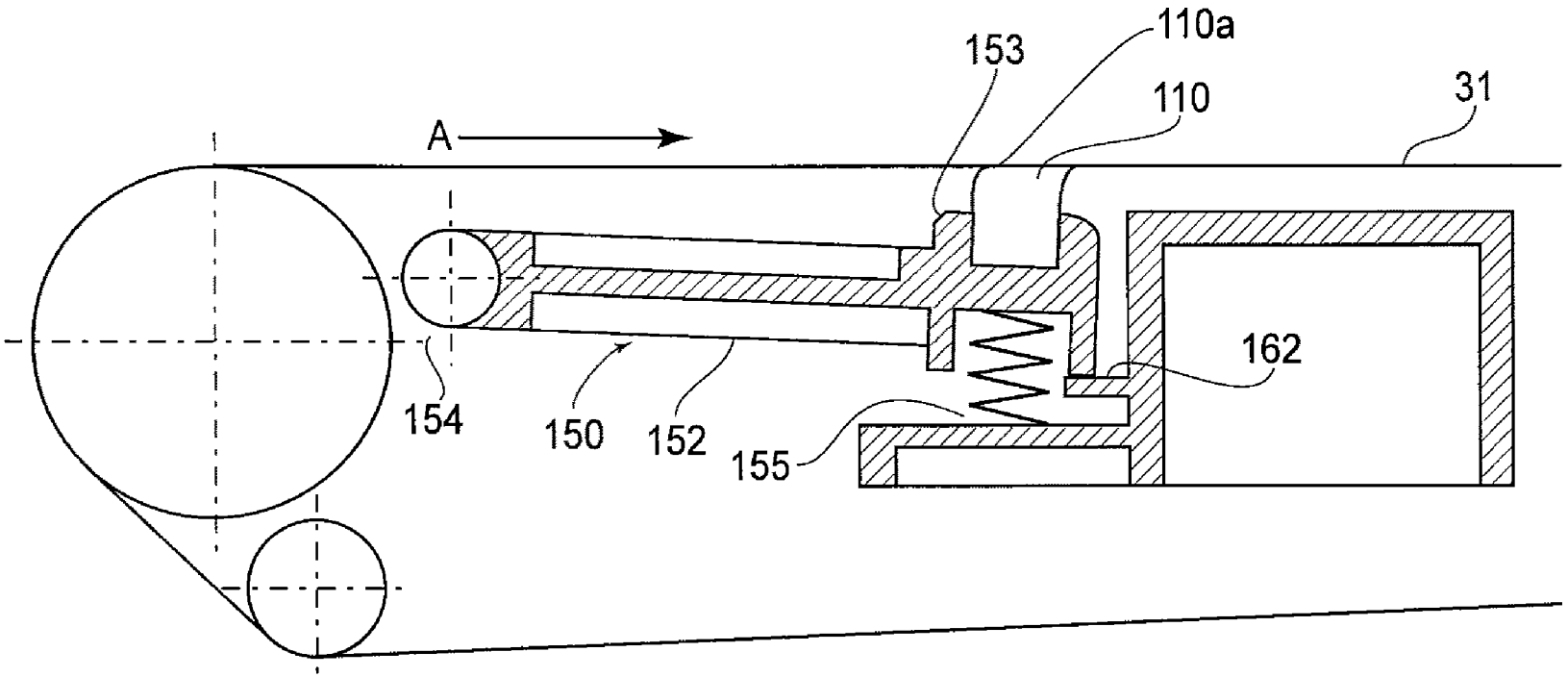
FIG. 17 is a sectional view of the image transferring means, and its adjacencies, in the fourth embodiment of the present invention.

When the intermediary transfer belt 31 is not moving, the elastic member 110 remains simply compressed by the compression springs 155 against the intermediary transfer belt 31 in the direction perpendicular to the flat area of the inward surface of the intermediary transfer belt 31. However, as the intermediary transfer belt 31 moves (rotates), frictional force is generated between the elastic member 110 and intermediary transfer belt 31, as shown in FIG. 17. This frictional force initiate the following sequence.

That is, also in this embodiment, as the intermediary transfer belt 31 moves, the elastic member 110 is tilted, altering the pressure distribution in the interface between the contact surface 110*a* and intermediary transfer belt 31; the pressure shifts upstream in terms of the moving direction of the intermediary transfer belt 31. Thus, the frictional force to which the elastic member 110 is subjected by the intermediary transfer belt 31 reduces. However, the amount by which the frictional force to which the elastic member 110 is subjected is reduced by the tilting of the elastic member 110 in this embodiment is different from that in the first embodiment, because the image forming apparatus in this embodiment is different, in the position of the axle of the holder, from the image forming apparatus in the first embodiment.

Also in this embodiment, the axle 154 is apart by a substantial distance from the contact surface 110*a* in terms of the moving direction of the intermediary transfer belt 31, and is on the inward side of the loop the intermediary transfer belt 31 forms. Further, the axle 154 is located upstream of the contact surface 110*a*. With the employment of this structural arrangement, therefore, as the contact surface 110*a* is subjected to the frictional force, which acts in the same direction as the moving direction of the intermediary transfer belt 31, such a force which acts in the direction to rotate the holder 101 in the direction indicated by an arrow mark B, that is, the direction to cause the elastic member 110 to separate from the intermediary transfer belt 31, bears upon the holder 101.

Figure 18:
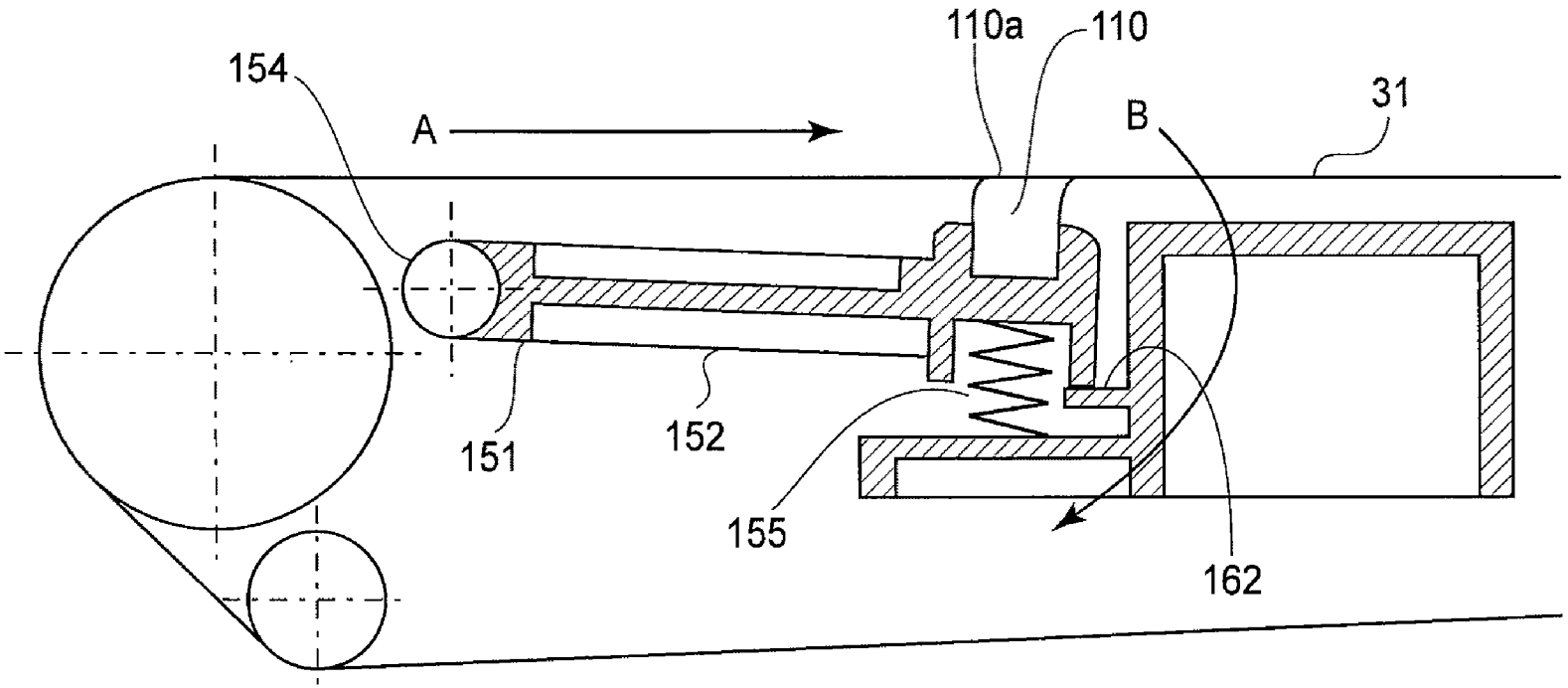
FIG. 18 is also a sectional view of the image transferring means, and its adjacencies, in the fourth embodiment of the present invention, showing the action thereof.
Figure 19:
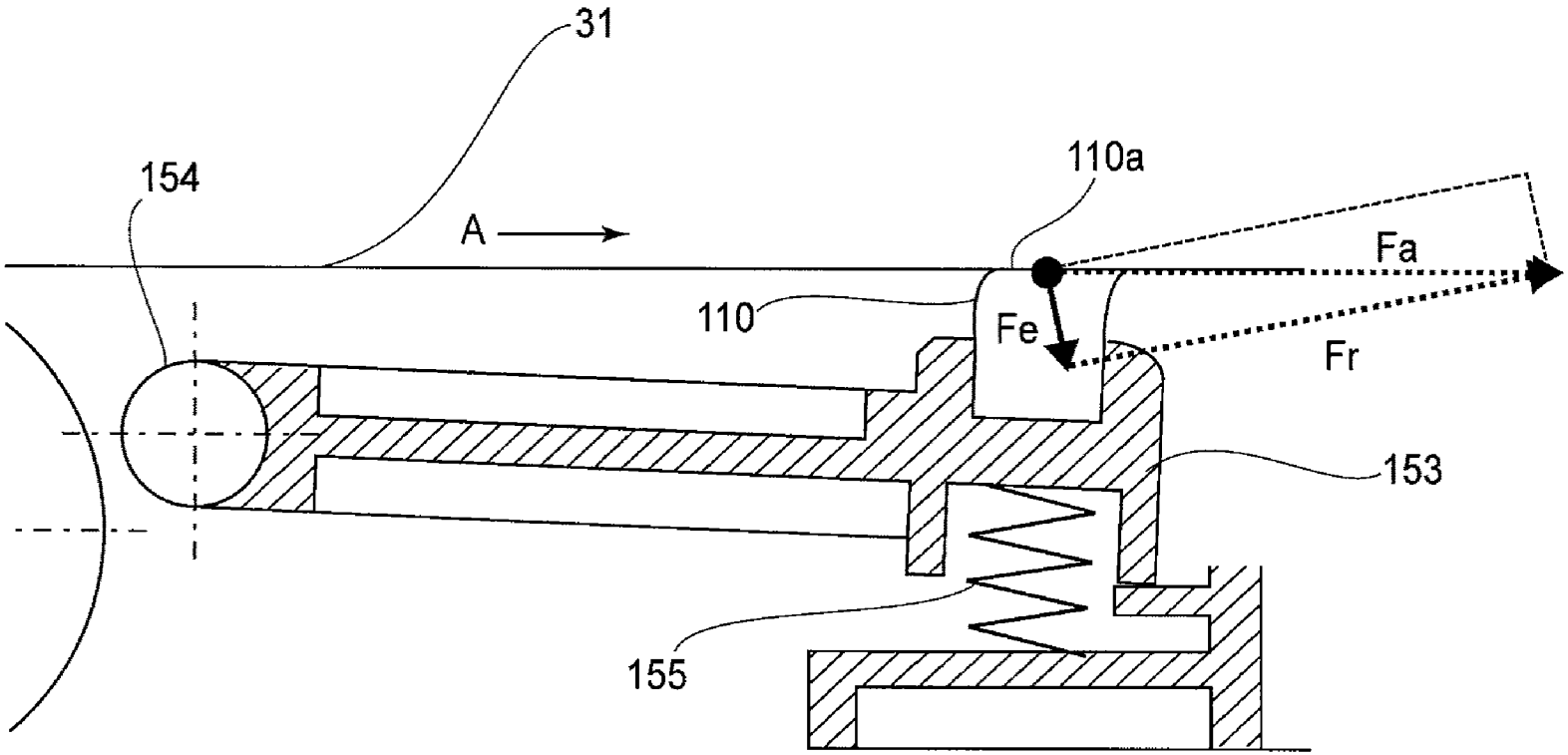
FIG. 19 is another sectional view of the image transferring means, and its adjacencies, in the fourth embodiment of the present invention, conceptually showing the force which bears upon the elastic member.

Therefore, the greater the force which acts in the direction to move the elastic member 110 in the direction parallel to the moving direction of the intermediary transfer belt 31, the greater the force which acts in the direction to cause the elastic member 110 to separate from the intermediary transfer belt 31. These forces are shown in FIG. 18. The force which acts in the direction to separate the elastic member 110 from the intermediary transfer belt 31 is roughly opposite in direction to the direction in which the elastic member 110 presses on the intermediary transfer belt 31. Therefore, the force which acts in the direction to separate the elastic member 110 from the intermediary transfer belt 31 contributes to the reduction in the frictional force between the intermediary transfer belt 31 and contact surface 110*a*. That is, according to the structural arrangement in this embodiment, the increase in the frictional force between the intermediary transfer belt 31 and contact surface 110*a* contributes to the reduction in the frictional force. Next, why the force which acts in the direction to cause the elastic member 110 to separate from the intermediary transfer belt 31 is generated will be stated with reference to FIG. 19. As a frictional force Fa is generated between the intermediary transfer belt 31 and elastic member 110, a rotational moment fθ is generated in the holder 153. The rotational moment fθ is a force which acts in a manner to rotate the holder 101 in the direction indicated by the arrow mark B. The frictional force Fa and fθ are proportional. That is, if the frictional force Fa increases by a certain amount due to the changes in the properties of the inward surface of the intermediary transfer belt 31, the rotational moment fθ proportionally increases. The increases in the rotational moment fθ contributes to the reduction in the frictional force Fa. Thus, the rotational moment fθ and frictional force Fa function together to make the holder 101 settle (keep the holder 101 tilted) at a certain angle which corresponds to the point of equilibrium between the rotational moment fθ and frictional force Fa.

Not only does the structural arrangement in this embodiment reduce the frictional force by changing the pressure distribution across the contact surface 110*a* so that the more upstream, the higher the pressure, and also, it reduces the frictional force by tilting the holder 153. In other words, the two functions synergistically work to achieve the objective of keeping stable the state of contact between the elastic member 110 and intermediary transfer belt 31.

Incidentally, the range of the rotation of the holder 153 is regulated by the rotation stopper 162. Therefore, even if the rotational speed of the intermediary transfer belt 31 is unstable, the contact surface 110*a* is kept in contact with the intermediary transfer belt 31, keeping thereby the transfer electric field stable. The presence of the rotation stopper 162 prevents the elastic member 110 from substantially moving, preventing thereby the transfer electric field from being seriously affected.

If the rotational speed of the intermediary transfer belt 31 is unstable, it is possible that the holder 153 will incessantly rotationally rock on its axle, because of the above-described functions of the structural arrangement. Thus, if the rotation stopper 162 is not provided, it is possible that the rotational rocking of the holder 101 will become excessive in amplitude, which in turn will because the contact surface 110*a* to separate from the intermediary transfer belt 31, making it impossible for an optimal electric field for image transfer to be formed.

Figure 20:
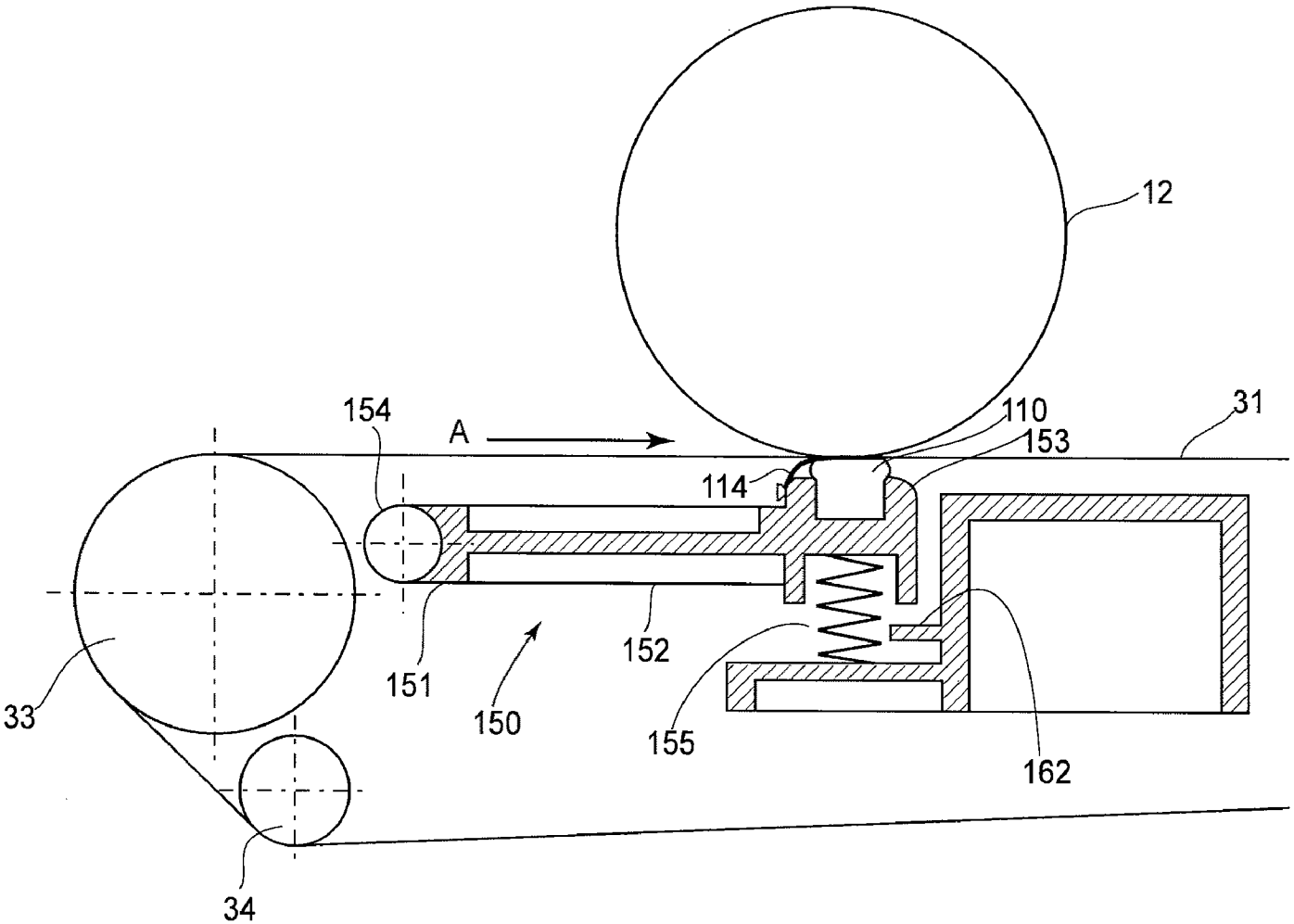
FIG. 20 is yet another sectional view of the image transferring means, and its adjacencies, in the fourth embodiment of the present invention.

Incidentally, this embodiment may also be modified. For example, a sheet, such as the one used in the second and third embodiments, may be placed between the elastic member 110 and intermediary transfer belt 31, as shown in FIG. 20.

Figure 21:
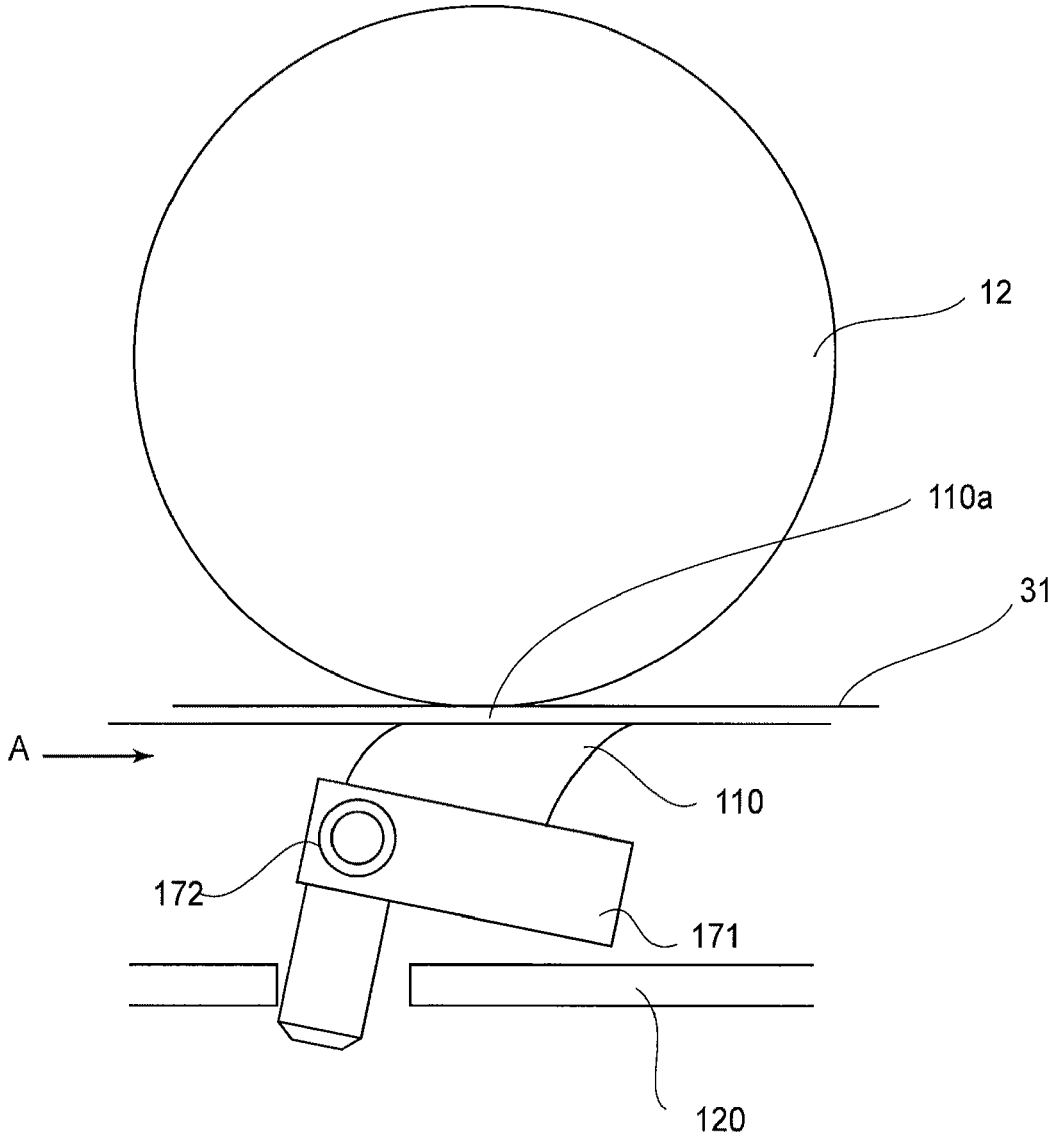
FIG. 21 is also a sectional view of the image transferring means, and its adjacencies, in the fourth embodiment of the present invention.
Figure 22:
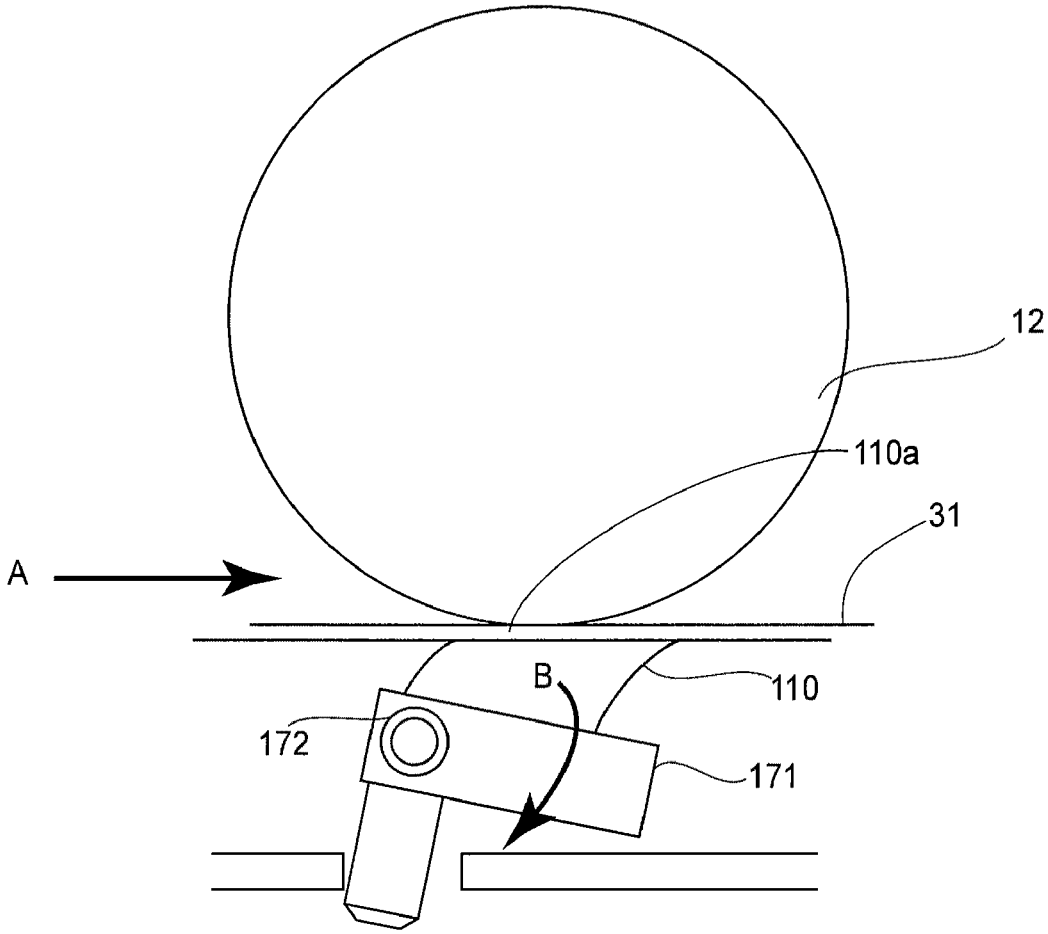
FIG. 22 is another sectional view of the image transferring means, and its adjacencies, in the fourth embodiment of the present invention, showing the action thereof.

Shown in FIG. 21 is another modification of this embodiment. The primary transferring means shown in FIG. 21 is structured so that the holder 171 is provided with an axle 172, the axial line of which is slightly offset from the center of the elastic member 110. The structural arrangement shown in FIG. 21 also generates the same force as the force generated in this embodiment, as shown in FIG. 22. In other words, this modification of the fourth embodiment also offers the same effects as those offered by the fourth embodiment.

<Embodiment 5>

Figure 23:
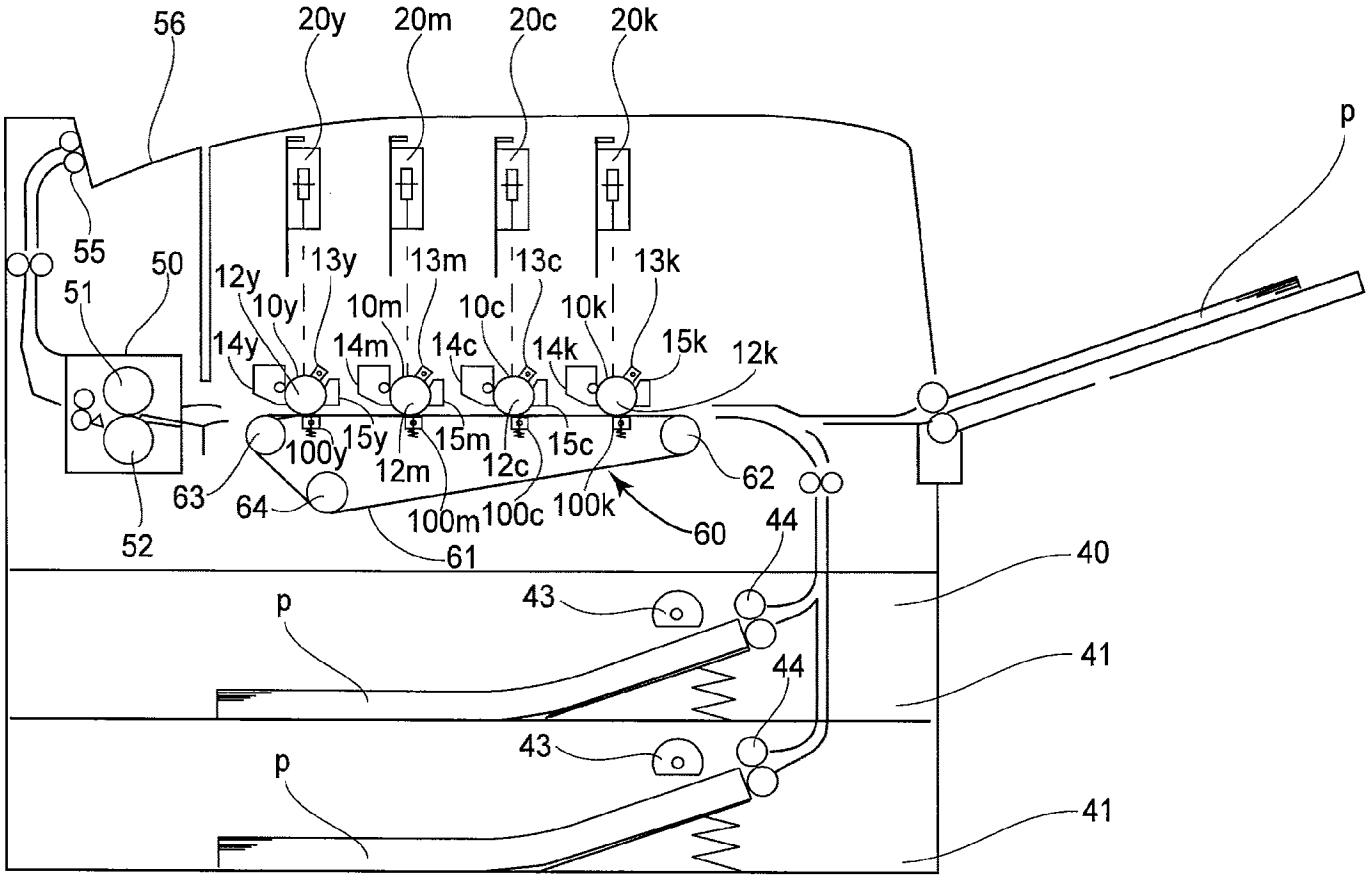
FIG. 23 is a sectional view of the image forming apparatus in the fifth embodiment of the present invention, showing the general structure thereof.

Next, referring to FIG. 23, the image forming apparatus in this embodiment will be described. This image forming apparatus is structured so that multiple toner images are transferred from multiple image forming stations, one for one, onto recording medium while the recording medium is borne and conveyed by the transfer belt; a color image is formed on the recording medium by sequentially transferring in layers multiple toner images from multiple image forming stations, one for one, onto the recording medium borne on the transfer belt.

Figure 24:
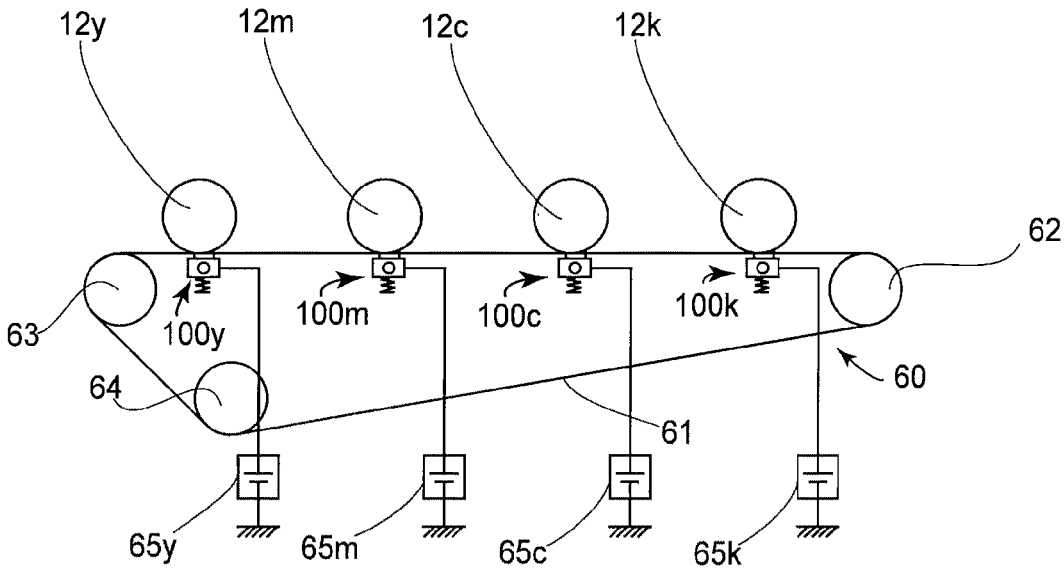
FIG. 24 is a sectional view of the recording medium bearing unit in the fifth embodiment of the present invention.

The structural arrangement for the primary transferring means, in the above-described first to fourth embodiments, are applicable to the image forming apparatus in this embodiment. With respect to the structures of the transferring member and its adjacencies in this embodiment, the image forming apparatus in this embodiment is essentially the same as those in the first to fourth embodiments, except that the image forming apparatus in this embodiment has a recording medium bearing unit 60 instead of the intermediary transfer unit 30 which the image forming apparatus in each of the above-described embodiments has. Referring to FIG. 24, the structures, etc., of a transferring means 190 are the same as those of the primary transferring means 100 in each of the above-described embodiments. Next, the structure of the image forming apparatus in this embodiment will be described.

The process cartridges 10*y*, 10*m*, 10*c* and 10*k* in this embodiment are roughly the same in structure as those in the first embodiment. That is, the process cartridges 10*y*, 10*m*, 10*c* and 10*k* in this embodiment are the same as those in the first embodiment in that each of them also has the photosensitive drum 12, charging means 13, developing apparatus 14, and cleaning apparatus 15, and also, in that each of them forms a toner image on the photosensitive drum 12.

In this embodiment, the recording medium bearing unit 60 is provided with a recording medium bearing belt 61, which is an endless belt, and three rollers 62, 63, and 64 which rotatably supports the recording medium bearing belt 61. The recording medium bearing unit 60 also has a transferring means 190 (190*y*, 190*m*, 190*c*, and 190*k*) for transferring a toner image formed on each photosensitive drum 12, onto the recording medium borne on the recording medium bearing belt 61. As the structure for the transferring means 190, the same structure as those of the primary transferring means 100 in the first to third embodiment may be employed.

The recording medium bearing belt 61 moves through the interface between the photosensitive drum 12 (12*y*, 12*m*, 12*c*, and 12*k*) and the transferring means 190. In each transfer area, or the interface between the photosensitive drum 12 and transferring means 190, a toner image formed on the photosensitive drum 12 is transferred by the transferring means 190, onto the recording medium on the recording medium bearing belt 61. That is, as the recording medium borne on the recording medium bearing belt 61 is moved through the interfaces between the photosensitive drums 12*y*, 12*m*, 12*c*, and 12*d*, and the recording medium bearing belt 61, the toner images formed on the photosensitive drums 12*y*, 12*m*, 12*c*, and 12*d* are sequentially transferred in layers onto the recording medium on the recording medium bearing belt 61. After the transfer of the toner images onto the recording medium on the recording medium bearing unit 60, the recording medium is conveyed through the fixation unit 50. As the recording medium is conveyed through the fixation unit 50, the toner images are fixed to the recording medium.

Any of the primary transferring means 100, etc., in the first to fourth embodiments described above is applicable to a transferring means, such as the transferring means 190 structured so that multiple toner images are directly transferred onto the recording medium borne on the recording medium bearing member 61. Such application yields the same effects as those yielded by the primary transferring means 100 in the first to fourth embodiments.

In each of the above-described preferred embodiments of the present invention, the image forming apparatus was structured to employ four image forming stations different in the color of the images they form. However, these embodiments are not intended to limit the number of the image forming stations. That is, the number of the image forming stations may be chosen as fits.

Also in each of the above described-preferred embodiments, the image forming apparatus was a printer. However, these embodiments are not intended to limit the scope of the present invention. That is, the present invention is also applicable to image forming apparatuses other than a printer. For example, not only is the present invention applicable to an image forming apparatus, such as a copying machine and a facsimile machine, but also, a multifunction image forming apparatus capable of performing two or more of the functions of the preceding image forming apparatuses. The application of the present invention to the transfer station of any of these image forming apparatuses yields the same effects as those described above.

Industrial Applicability

As described hereinabove, according to the present invention, it is possible to provide an image forming apparatus which employs an image transferring member, the entirety of one of the surfaces of which makes contact with the inward surface of a belt (in terms of loop belt forms), and which is characterized in that even while an image forming is actually formed, the image transferring member remains satisfactorily in contact with the belt.

While the invention has been described with reference to the structures disclosed herein, it is not confined to the details set forth, and this application is intended to cover such modifications or changes as may come within the purposes of the improvements or the scope of the following claims.

The invention claimed is:

1. An image forming apparatus comprising:

an image bearing member for carrying a toner image;

an endless intermediary transfer belt which is movable along an endless path;

a transfer member for transferring the toner image from said image bearing member onto a surface of said belt;

a supporting member having a supporting portion for supporting said transfer member, wherein said transfer member includes an elastic member having a contact surface which is capable of surface-contact to an inside surface of said belt without rotation relative to said supporting member; and an urging member for urging said supporting member in an urging direction toward said belt, said urging member, said supporting portion, and said elastic member being disposed in the order named along the urging direction, wherein said supporting member is rotatable, during movement of said belt, about an axis of a rotational shaft so as to move in a direction perpendicular to a moving direction of said belt, wherein said urging member urges said supporting member to effect the surface-contact of said elastic member to said belt during movement of said belt and, wherein said rotational shaft is disposed at a position which is away from an inner surface of said belt in the endless path and which is upstream of said elastic member with respect to the moving direction of said belt.

2. An image forming apparatus according to claim 1, wherein said elastic member has a polyhedron configuration having a plurality of surfaces including said contact surface.

3. An image forming apparatus according to claim 1, further comprising a regulating portion, disposed at a position downstream of said elastic member with respect to the moving direction of said belt, for regulating rotation of said supporting member.

4. An image forming apparatus according to claim 1, further comprising a fixed bearing portion supporting said rotational shaft.

5. An image forming apparatus comprising:

an image bearing member for carrying a toner image;

an endless intermediary transfer belt which is movable along an endless path;

a transfer member for transferring the toner image from said image bearing member onto a surface of said belt;

a supporting member having a supporting portion for supporting said transfer member, wherein said transfer member includes a film capable of area contact with an inner surface of said belt, and an elastic member capable of surface-contact to said film without rotation relative to said supporting member; and an urging member for urging said supporting member in an urging direction toward said belt, said urging member, said supporting portion, and said elastic member being disposed in the order named along the urging direction, wherein said supporting member is rotatable, during movement of said belt, about an axis of a rotational shaft so as to move in a direction perpendicular to a moving direction of said belt, wherein said urging member urges said supporting member to urge said elastic member to said belt through said film during movement of said belt, wherein said rotational shaft is disposed at a position which is away from an inner surface of said belt in the endless path and which is upstream of said elastic member with respect to the moving direction of said belt.

6. An image forming apparatus according to claim 5, wherein said elastic member has a polyhedron configuration having a plurality of surfaces including a contact surface contactable to said film without rotation.

7. An image forming apparatus according to claim 5, wherein said film is an electrically-conductive sheet.

8. An image forming apparatus according to claim 5, wherein said film is fixed to said supporting member.

9. An image forming apparatus according to claim 5, further comprising a regulating portion, disposed at a position downstream of said elastic member with respect to the moving direction of said belt, for regulating rotation of said supporting member.

10. An image forming apparatus according to claim 5, further comprising a fixed bearing portion supporting said rotational shaft.

11. An image forming apparatus comprising:

an image bearing member for carrying a toner image;

a movable endless recording material carrying belt which is movable along an endless path;

a transfer member for transferring the toner image from said image bearing member onto a recording material carried on said belt;

a supporting member having a supporting portion for supporting said transfer member, wherein said transfer member includes an elastic member having a contact surface which is capable of surface-contact to an inside surface of said belt without rotation relative to said supporting member; and an urging member for urging said supporting member in an urging direction toward said belt, said urging member, said supporting portion, and said elastic member being disposed in the order named along the urging direction, wherein said supporting member is rotatable, during movement of said belt, about an axis of a rotational shaft so as to move in a direction perpendicular to a moving direction of said belt, wherein said urging member urges said supporting member to effect the surface-contact of said elastic member to said belt during movement of said belt and, wherein said rotational shaft is disposed at a position which is away from an inner surface of said belt in the endless path and which is upstream of said elastic member with respect to the moving direction of said belt.

12. An image forming apparatus according to claim 11, wherein said elastic member has a polyhedron configuration having a plurality of surfaces including said contact surface.

13. An image forming apparatus according to claim 11, further comprising a regulating portion, disposed at a position downstream of said elastic member with respect to the moving direction of said belt, for regulating rotation of said supporting member.

14. An image forming apparatus according to claim 11, further comprising a fixed bearing portion supporting said rotational shaft.

15. An image forming apparatus comprising:

an image bearing member for carrying a toner image;

a movable endless recording material carrying belt which is movable along an endless path;

a transfer member for transferring the toner image from said image bearing member onto a recording material carried on said belt;

a supporting member having a supporting portion for supporting said transfer member, wherein said transfer member includes a film capable of area contact with an inner surface of said belt, and an elastic member capable of surface-contact to said film without rotation relative to said supporting member; and an urging member for urging said supporting member in an urging direction toward said belt, said urging member, said supporting portion, and said elastic member being disposed in the order named along the urging direction, wherein said supporting member is rotatable, during movement of said belt, about an axis of a rotational shaft so as to move in a direction perpendicular to a moving direction of said belt, wherein said urging member urges said supporting member to urge said elastic member to said belt through said film during movement of said belt and, wherein said rotational shaft is disposed at a position which is away from an inner surface of said belt in the endless path and which is upstream of said elastic member with respect to the moving direction of said belt.

16. An image forming apparatus according to claim 15, wherein said elastic member has a polyhedron configuration having a plurality of surfaces including a contact surface contactable to said film without rotation.

17. An image forming apparatus according to claim 15, wherein said film is an electrically-conductive sheet.

18. An image forming apparatus according to claim 15, wherein said film is fixed to said supporting member.

19. An image forming apparatus according to claim 15, further comprising a regulating portion, disposed at a position downstream of said elastic member with respect to the moving direction of said belt, for regulating rotation of said supporting member.

20. An image forming apparatus according to claim 15, further comprising a fixed bearing portion supporting said rotational shaft.

* * * * *